US010314356B2

(12) United States Patent
Kenna

(10) Patent No.: US 10,314,356 B2
(45) **Date of Patent: *Jun. 11, 2019**

(54) METHODS FOR ATTACHING HAIR EXTENSIONS TO NATURAL HAIR OF A USER

(71) Applicant: Lisa Kenna, Boca Raton, FL (US)

(72) Inventor: Lisa Kenna, Boca Raton, FL (US)

( * ) Notice: Subject to any disclaimer, the term of this patent is extended or adjusted under 35 U.S.C. 154(b) by 682 days.

This patent is subject to a terminal disclaimer.

(21) Appl. No.: 14/752,976

(22) Filed: Jun. 28, 2015

(65) Prior Publication Data

US 2015/0296912 A1 Oct. 22, 2015

Related U.S. Application Data

(63) Continuation-in-part of application No. 12/317,810, filed on Dec. 29, 2008, now Pat. No. 9,339,072.

(51) Int. Cl.
*A41G 3/00* (2006.01)
*A41G 5/00* (2006.01)

(52) U.S. Cl.
CPC ..... *A41G 5/008* (2013.01)

(58) Field of Classification Search
CPC ..... A41G 5/00; A41G 5/0033; A41G 5/004; A41G 5/008; A41G 5/0053; A41G 5/006
See application file for complete search history.

(56) References Cited

U.S. PATENT DOCUMENTS 3,835,868 A 9/1974 Heck
4,934,387 A 6/1990 Megna
5,413,124 A 5/1995 Incando
5,722,434 A 3/1998 Walker
5,868,145 A 2/1999 Spann
5,937,867 A 8/1999 Williams
7,201,171 B2 * 4/2007 Sthair ..... A41G 5/004 132/201
7,533,676 B2 5/2009 Sthair
8,191,556 B2 6/2012 Betts
2001/0037813 A1 11/2001 Ra
(Continued)

OTHER PUBLICATIONS

U.S. Patent and Trademark Office; Office Action dated Jan. 4, 2012, as entered in parent U.S. Appl. No. 12/317,810 (6 pages).
(Continued)

*Primary Examiner* — Rachel R Steitz
(74) *Attorney, Agent, or Firm* — Daniel Crilly, P.A.; Daniel C. Crilly

(57) ABSTRACT

Various methods are used to attach hair extensions to a user's hair. According to one method, a user's hair is parted and adhesive tape of a first extension is attached to hair above the part. The first extension and attached hair are lowered, and a second extension is positioned above the lowered extension such that adhesive tape of the second extension substantially aligns with the first extension's tape. The second extension's tape is attached to the user's hair to sandwich the hair between the two extensions. According to another method, a user's hair is parted and a first adhesive tape on one side of an extension is attached to hair below the part. Hair above the part is lowered and attached to the extension's other side using a second tape. A third tape is attached to the user's hair below the first tape to seal the hair between the tapes.

13 Claims, 21 Drawing Sheets

(56) References Cited

U.S. PATENT DOCUMENTS

| | | | | |
|---|---|---|---|---|
| 2004/0011371 | A1 | 1/2004 | Harrison | |
| 2006/0144413 | A1 | 7/2006 | Yoneda et al. | |
| 2006/0169297 | A1 | 8/2006 | Gill et al. | |
| 2007/0006890 | A1* | 1/2007 | Sthair | A41G 5/008 132/201 |
| 2007/0157944 | A1 | 7/2007 | Catron et al. | |
| 2011/0005544 | A1 | 1/2011 | Lane | |
| 2011/0094530 | A1 | 4/2011 | Sedillo-Beadell | |

OTHER PUBLICATIONS

Amendment and Response dated Jul. 3, 2012, as filed in parent U.S. Appl. No. 12/317,810 (19 pages).
U.S. Patent and Trademark Office; Final Office Action dated Oct. 24, 2012, as entered in parent U.S. Appl. No. 12/317,810 (6 pages).
Amendment and Response dated Jan. 17, 2013, as filed in parent U.S. Appl. No. 12/317,810 (7 pages).
Amendment and Response in Support of a Request for Continued Examination dated Feb. 25, 2013, as filed in parent U.S. Appl. No. 12/317,810 (21 pages).
U.S. Patent and Trademark Office; Office Action dated Jan. 15, 2014, as entered in parent U.S. Appl. No. 12/317,810 (7 pages).
Amendment and Response dated May 13, 2014, as filed in parent U.S. Appl. No. 12/317,810 (18 pages).
U.S. Patent and Trademark Office; Final Office Action dated Aug. 26, 2014, as entered in parent U.S. Appl. No. 12/317,810 (7 pages).
U.S. Patent and Trademark Office; Office Action dated Nov. 20, 2014, as entered in parent U.S. Appl. No. 12/317,810 (9 pages).
Amendment and Response dated Apr. 17, 2015, as filed in parent U.S. Appl. No. 12/317,810 (18 pages).
U.S. Patent and Trademark Office; Notice of Allowability dated Aug. 13, 2015, as entered in parent U.S. Appl. No. 12/317,810 (1 page).
Submission in Support of a Request for Continued Examination dated Nov. 4, 2015, as filed in parent U.S. Appl. No. 12/317,810 (15 pages).
Great Hair, Inc., Platinum Seamless 2011 Training Manual, Oct. 2011 (21 pages).
Great Hair, Inc., Platinum Seamless Certification Training Manual, May 2010 (22 pages).
Great Hair, Inc., Platinum Seamless Training Manual, Apr. 2009 (36 pages).

* cited by examiner

METHODS FOR ATTACHING HAIR EXTENSIONS TO NATURAL HAIR OF A USER

CROSS-REFERENCE TO RELATED APPLICATIONS

The present application is a continuation-in-part of U.S. application Ser. No. 12/317,810, which was filed on Dec. 29, 2008 and is incorporated herein by this reference as if fully set forth herein. U.S. application Ser. No. 12/317,810 is a continuation-in-part of International Application No. PCT/US2006/036890, now expired, which was filed on Sep. 23, 2006 and is also incorporated herein by reference as if fully set forth herein. U.S. application Ser. No. 12/317,810 further claims the benefit of U.S. Provisional Application No. 61/010,411, which was filed on Jan. 8, 2008 and is incorporated herein by this reference as if fully set forth herein.

BACKGROUND

Field of the Invention

The present invention relates generally to hair enhancement techniques and more particularly to methods for attaching hair extensions to users' natural hair.

Description of Related Art

Hair extensions have been used in the hair styling industry for many years. Users and stylists have made use of products to enhance the length of a user's hair or to add body or bulk to thinning hair. Many of the products on the market are made from synthetic hair, but these products up until now have not been able to be heat-styled with a blow dryer, flat iron, or hot rollers. Prior synthetic products would melt when a heat source was used.

To facilitate attachment to users' hair, some existing hair extension products use clip-on extensions. These clip-on extensions are available for the home or professional market. Clip-on extensions are not semi-permanent, must be re-applied daily, can damage natural hair, can fall out unexpectedly and are only feasible if the user's hair is thick enough to cover the clip.

Many other hair extension products on the market require the use of a liquid adhesive to secure the extensions to users' hair. This generally prevents the average consumer from installing their own extensions. Sewn in extensions, braided style extensions and heat applied extensions can be as damaging to natural hair as liquid adhesive applied with latex glue.

Some hair extension products on the market permit the use of adhesive tape to secure the extensions to a user's hair but require the tape portion to be applied to the user's hair first and then the hair extensions to be placed on the already applied tape portion. Such an application process is difficult for the average consumer and can result in poorly attached extensions.

Other background methods use pre-tipped hair, which must be tediously applied, uses chemicals and heat for application and removal, and can cause significant damage to natural hair.

SUMMARY

Generally, the disclosed embodiments relate to methods for attaching one or more hair extensions to a user's natural hair. According to one exemplary method, natural hair of the user is parted, horizontally or otherwise, to form a part. A first hair extension is attached to natural hair of the user above the part (preferably, but not necessarily, at the part line or just above). The first hair extension includes a section of hair and an adhesive tape, and the section of hair is affixed together at one end. The adhesive tape is attached to one side of the section of hair proximate the affixed-together end. The adhesive tape may be double-sided or single-sided. Where the adhesive tape is double-sided, a first side of the tape is attached to a first side of the section of hair, and a second side of the tape is outward-facing and used to attach the first extension's section of hair to natural hair of the user above the part. The outward-facing side of the adhesive tape may be covered with a removable liner to prevent the tape from sticking to other objects and potentially losing some or all of its tackiness. The liner may be removed at the time the first hair extension is installed. Where the adhesive tape is single-sided, the non-sticky side of the adhesive tape may be attached to the first side of the section of hair using a liquid adhesive or another double-sided adhesive tape, and the sticky, outward-facing side of the tape may be used to attach the first extension's section of hair to natural hair of the user above the part. Again, the outward-facing side of the adhesive tape may be covered with a removable liner to insure the tape retains its tackiness until the time the hair extension is installed.

After the first hair extension has been attached to natural hair of the user above the part, the first hair extension and the user's attached natural hair are lowered. The user's hair attached to the first extension will typically be a very thin layer of hair. A comb, such as a rat tail comb, may be used to clear away extraneous hair that was lowered during lowering of the first extension, but is either not attached to the first extension or not securely attached to the first extension. A second hair extension is then positioned above the lowered first hair extension and attached user's hair. The second hair extension includes a section of hair and an adhesive tape, and the section of hair is affixed together at one end. The adhesive tape of the second extension is attached to one side of the section of hair proximate the affixed-together end of the section of hair. The adhesive tape, the manner in which it is attached to the second extension's section of hair, and the optional use of a removable liner may be as discussed above with respect to the adhesive tape of the first extension. The second extension is positioned above the first extension such that the adhesive tapes of the two extension are substantially aligned across a width of the first extension (and alternatively across a width of the second extension, where the two extensions are about the same width). The adhesive tape of the second extension is attached to the user's natural hair which is already attached to the adhesive tape of the lowered first extension such that the user's hair is sandwiched between the two adhesive tapes and, therefore, the two extensions.

According to another exemplary hair extension attachment method, natural hair of the user is parted, horizontally or otherwise, to form a part. First adhesive tape on one side of a hair extension is attached to natural hair of the user below the part (preferably, but not necessarily, at the part line or just below), where the hair extension includes a section of hair and the first adhesive tape. The hair extension's section of hair is affixed together at one end and the first adhesive tape is attached to one side of the section of hair proximate the affixed-together end of the section of hair. The adhesive tape may be double-sided or single-sided. Where the adhesive tape is double-sided, a first side of the tape is attached to a first side of the section of hair, and a second side of the tape is outward-facing and used to attach the extension's section of hair to natural hair of the user below the part. The outward-facing side of the adhesive tape may be covered with a removable liner to prevent the tape from sticking to other objects and potentially losing some or all of its tackiness. The liner may be removed at the time the hair extension is installed. Where the adhesive tape is single-sided, the non-sticky side of the adhesive tape may be attached to the first side of the section of hair using a liquid adhesive or another double-sided adhesive tape, and the sticky, outward-facing side of the tape may be used to attach the extension's section of hair to natural hair of the user below the part. Again, the outward-facing side of the adhesive tape may be covered with a removable liner to insure the tape retains its tackiness until the time the hair extension is installed.

After the hair extension has been attached to natural hair of the user below the part, natural hair of the user from above the part is lowered and attached to the hair extension using a second adhesive tape. The second adhesive tape may be pre-attached to the extension's section of hair on the opposite side of the extension, thereby forming part of the extension, or the second tape may be attached to the extension at the time of installation. The second adhesive tape, the manner in which it is attached to the extension's section of hair, and the optional use of a removable liner may be as discussed above with respect to the first adhesive tape forming part of the extension. Additionally, a third adhesive tape is attached to natural hair of the user that is attached to the first adhesive tape such that the third adhesive tape is positioned below or beneath the first adhesive tape and natural hair of the user is sandwiched or sealed between the third adhesive tape and the first adhesive tape. The third adhesive tape may be applied as a matter of course or may be limited to situations in which additional hold for the extension is determined to be necessary based on the user's lifestyle and/or the type, texture, and/or condition of the user's hair. The third adhesive tape is preferably single-sided, but may be double-sided if necessary to provide additional hold to the user's hair below the tape.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Skilled artisans will appreciate that elements in the figures are illustrated for simplicity and clarity and have not necessarily been drawn to scale. For example, the dimensions of some of the elements in the figures have been exaggerated alone or relative to other elements to help improve the understanding of the various disclosed embodiments.

DESCRIPTION OF EXEMPLARY EMBODIMENTS

In this document, relational terms, such as "first" and "second," "top" and "bottom," "front" and "rear," and the like are used solely to distinguish one entity or element from another entity or element without necessarily requiring or implying any physical or logical relationship or order between such entities or elements. The terms "comprises," "comprising," "includes," "including," "contains," "containing," "has," "having," and/or any other variations thereof are intended to cover a non-exclusive and non-exhaustive inclusion, such that a process, method, article, or apparatus that comprises, includes, contains, or has a list of elements, characteristics, or features does not include only those elements, characteristics, or features but may include other elements, characteristics, or features not expressly listed or inherent to such process, method, article, or apparatus. The term "plurality of" as used in connection with any object or action means two or more of such object or action. A claim element proceeded by the article "a" or "an" does not, without more constraints, preclude the existence of additional identical elements in the process, method, article, or apparatus that includes the element.

Figure 1:
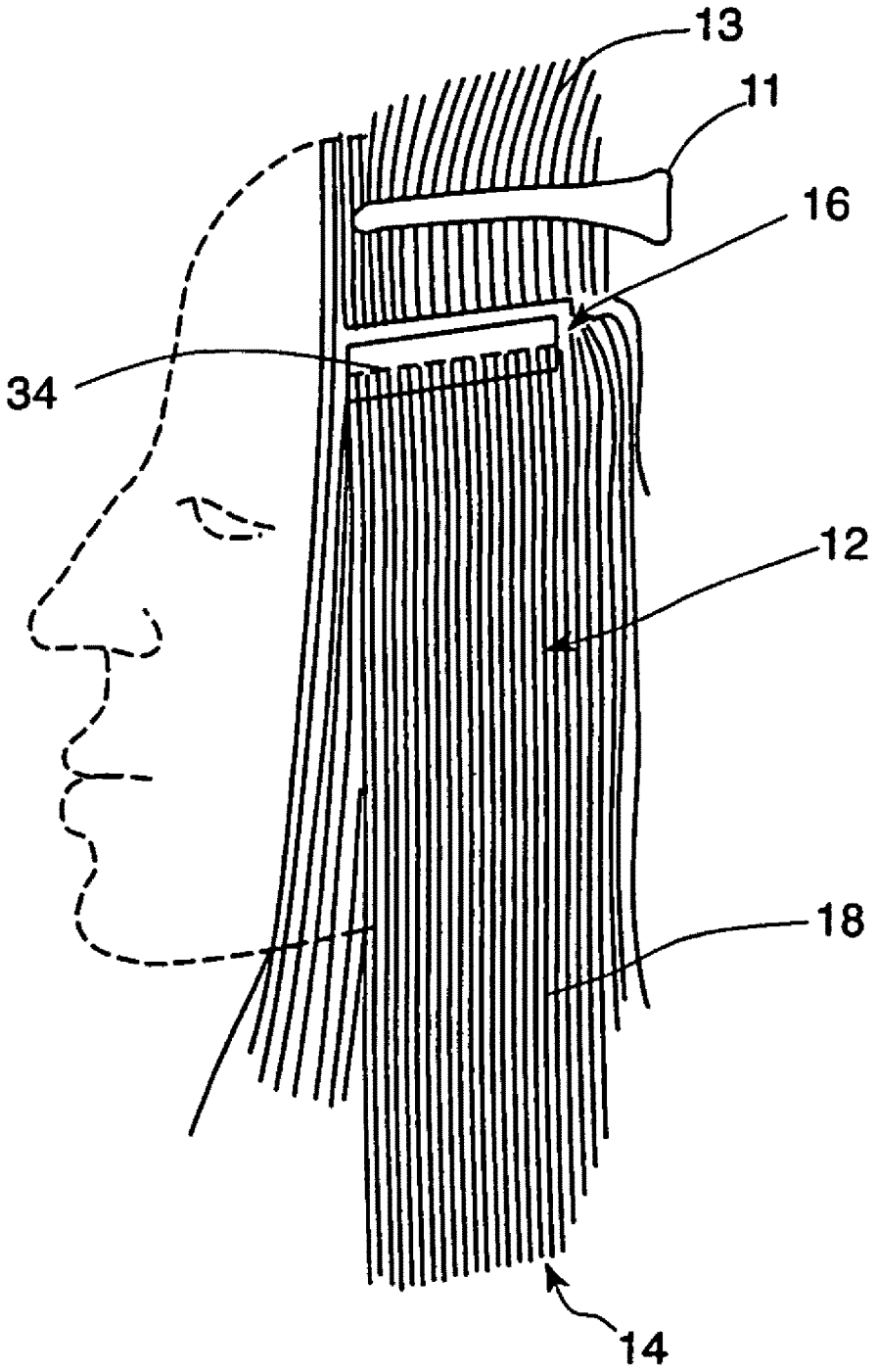
FIG. 1 shows a side view of one embodiment of the human or synthetic fiber hair extension affixed to a user's head.

Referring to the drawings in detail wherein like elements are indicated by like numerals, there is shown in FIG. 1 one embodiment of a human or synthetic fiber hair extension 12 affixed to a user's head. The hair extension 12 has a fixed end 16 which is attached to the user's hair along a part line. The hair extension 12 has a free end 14 in which hair 18 hangs freely at a user desired length. A preferred length of the hair is approximately 18 to 20 inches long. Obviously the hair extensions 12 can be cut or styled if a shorter length is desired.

Hair 18 is preferably manufactured from a polyester, one that is capable of being styled with a blow drier, flat iron, hot rollers, or other heat appliances and behaves much like natural hair. Hair 18 can also be a human or synthetic blend.

Figure 2:
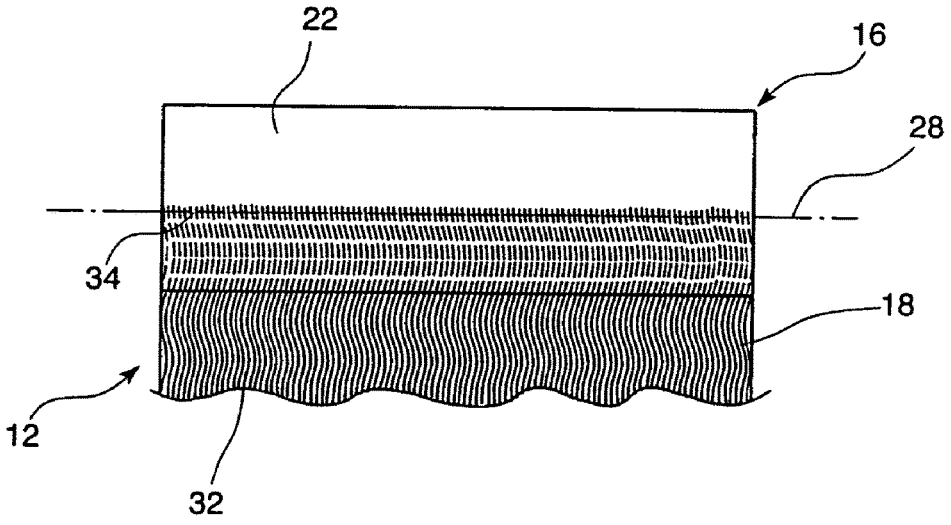
FIG. 2 shows a more detailed side view one of the hair extension embodiment of FIG. 1.

FIG. 2 shows a detailed view of the fixed end 16. A hair weft 34 is attached to the second tape 22 along a mid-line 28. The hair 18 is secured between the second tape 22 and the first tape 20, not shown. A preferred length of the first and second tapes 20, 22 and width of the hair extension 12 is approximately 1.5 to 4 inches. A preferred width of the first and second tapes 20, 22 is ¾" wide, but other widths may be functional. Obviously the length of hair 18 can be cut depending upon the user's preference. The first tape 20 and the second tape 22 should be of a thickness that is relatively thin such that it is relatively pliable and soft and cannot be felt by the wearer.

The first and second tapes 20, 22 can also have "tabs" (not shown) to ease the removal of the first and second covers 24, 26. The tabs can be extended backing so that the user can grasp the covers 24, 26 easier to remove them. Alternatively, the covers 24, 26 can be scored such that the user can fold the tapes 20, 22 to ease the removal of the covers 24, 26.

Figure 3:
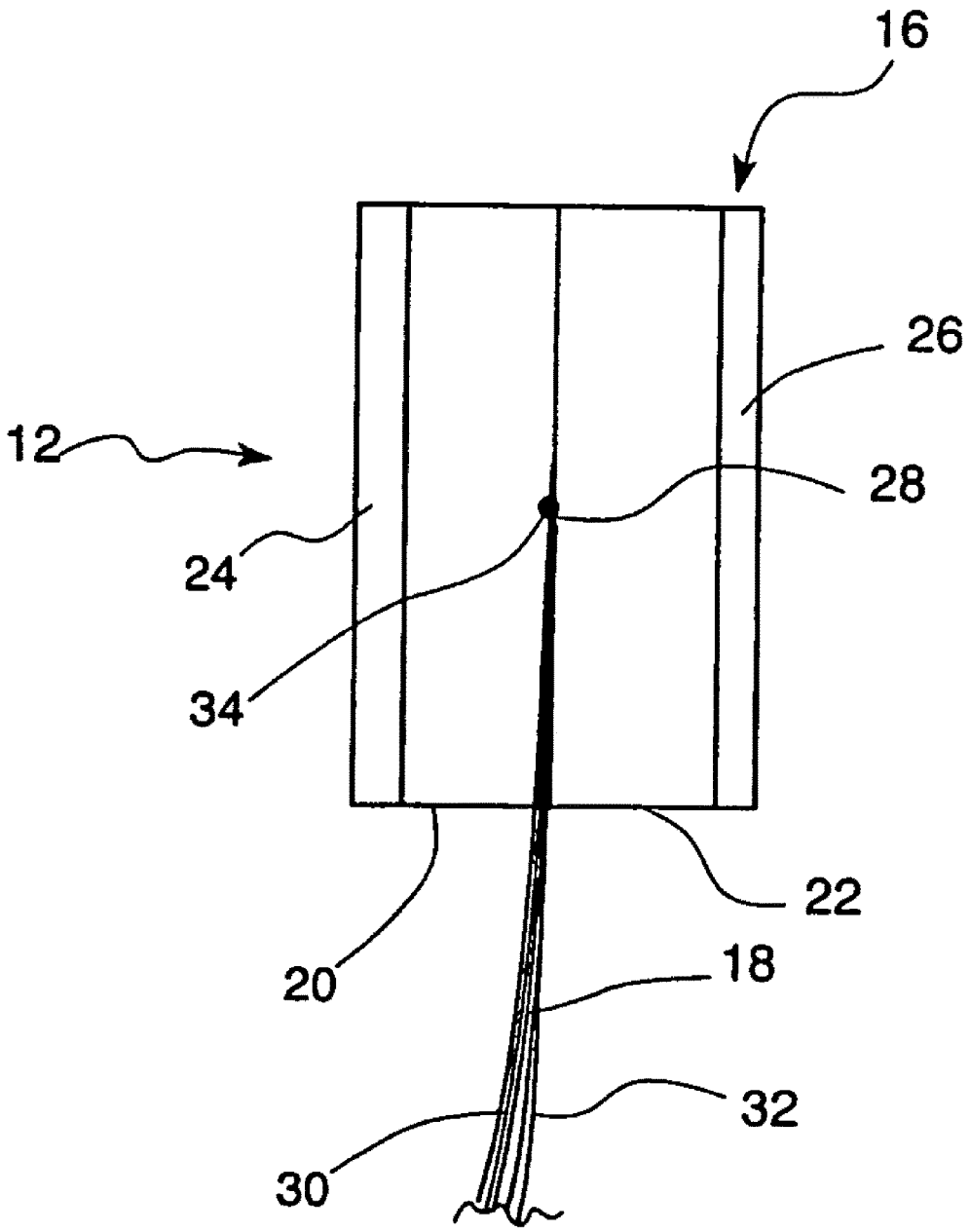
FIG. 3 shows an exaggerated end view of the hair extension embodiment of FIG. 1.

FIG. 3 shows an end view of the fixed end 16. Here it can be seen that the hair 18 is secured between the first tape 20 and the second tape 22 at the mid-line 28. The mid-line 28 is about halfway between the top and bottom edges of the first tape 20 and second tape 22. The first tape 20 is a piece of double sided tape. To assemble the hair extension 12 requires the removal of a cover or liner (not shown) from one side of the first tape 20 and securing the hair 18 at the mid-line 28. A cover or liner (not shown) is removed from one side of the second tape 22 and the exposed side is secured to the hair 18 and in a corresponding location to the first tape 20.

A preferred width of the first and second tape is approximately ¾ inches wide. Obviously other widths may be functional, but it has been determined that a width of ¾ inches provides the best extended retention ability while still being able to be hidden in the user's natural hair.

Attached to the other side of the first tape 20 is first cover or liner 24. Attached to the other side of second tape 22 is second cover or liner 26. The covers 24, 26 are removed and discarded to attach the hair extension 12 to the user's hair.

The hair 18 can show a first color 46 on the first side 30 and a second color 48 on the second side 32. This would allow a user to secure the hair extension 12 with either the first side 30 or second side 32 for view depending on the effect that was desired. The first and second sides 30, 32 of the extension's hair 18 can be corresponding colors or much different colors. This provides more options for the user. It may be desirable to have a color that matches the user's hair or one that is slightly different to achieve a different look or a color that is much different than the user's hair color.

First tape 20 can also correspond to the first color 46 of the hair 18 on the first side 30. Likewise, second tape 22 can correspond to the second color 48 of the hair 18 on the second side 32. The matching of the tapes 20, 22 to the sides 30, 32 of the hair 18 helps to hide the fixed end 16 of the hair extension 12 when attached to the natural hair 13 of the user.

In one embodiment, the first tape 20 corresponds to the color of the hair 18 first side 30 and second tape 22 corresponds to the color of the hair 18 second side 32. Alternative embodiments have the first tape 20 and second tape 22 made from a clear double sided tape which also aids to hide the fixed end 16 of the hair extension 12.

Figure 4:
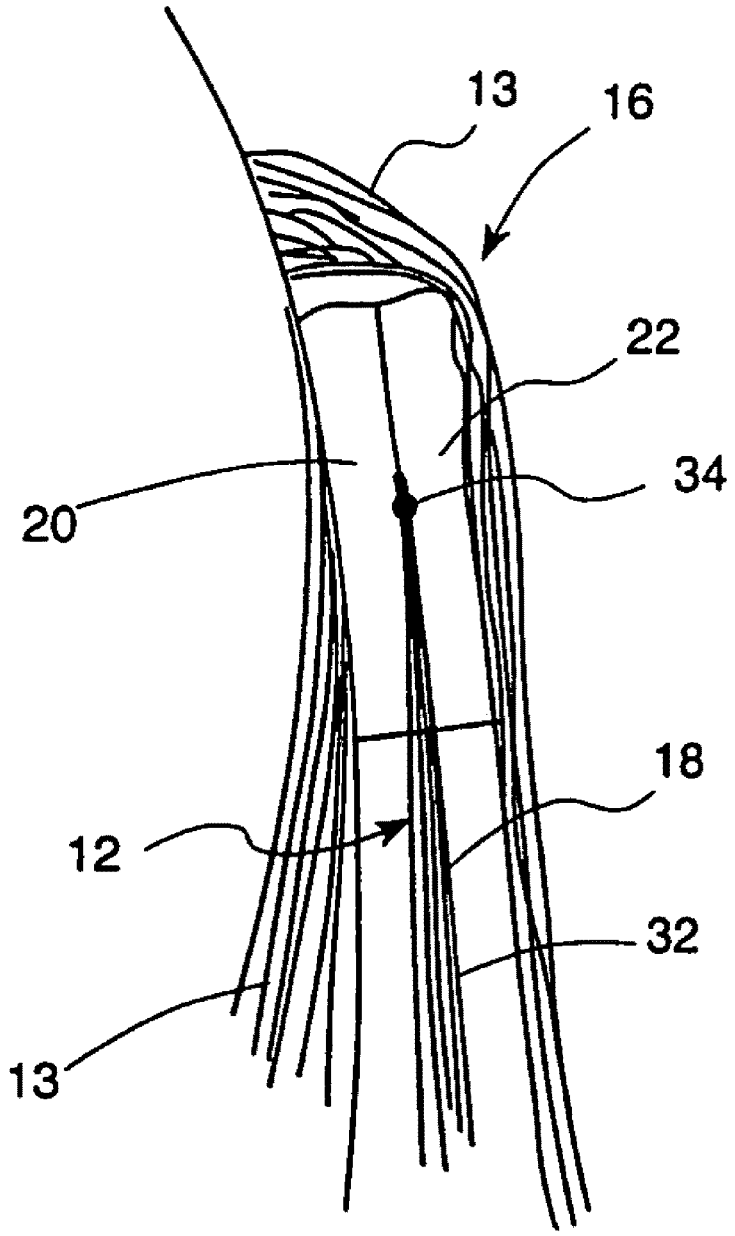
FIG. 4 shows an exaggerated end view of the hair extension embodiment of FIG. 1 as attached to a user's head.

FIG. 4 is an exaggerated view of the fixed end 16 of the hair extension 12 attached to a user's natural hair 13. To attach the hair extension 12, the user should shampoo first with a clarifying shampoo that removes oils and other residue that may adversely affect the attachment of the hair extensions 12. Once the hair is dried, the user makes a part line in the natural hair 13 and secures the natural hair 13 with, for example, a hair clip 11, such as shown in FIG. 1. The user than removes the first cover or liner 24 and places the first tape 20 onto the user's hair 13 below the part line. The second cover or liner 26 is then removed and discarded, and the user's hair that had been retained by the hair clip 11 is released to fall naturally over the second tape 22. After the hair falls naturally onto the second tape 22 it can be pressed to the fixed end 16 of the hair extension 12 and the hair extension 12 is then secured to the user's natural hair 13.

Figure 5:
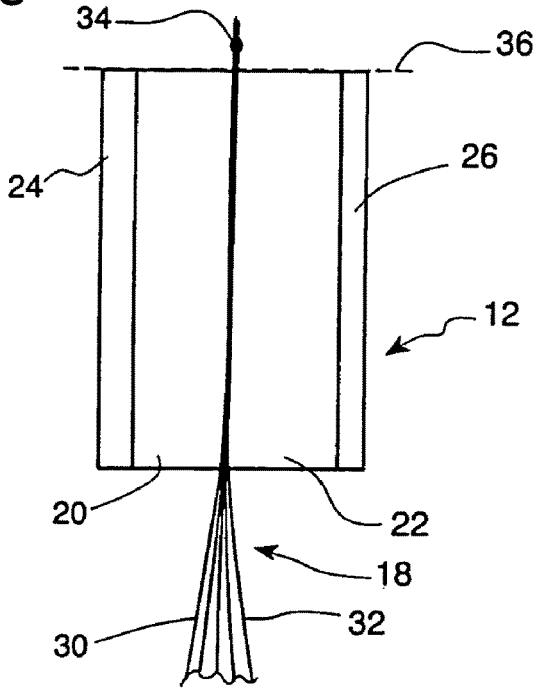
FIG. 5 shows an exaggerated end view of another embodiment of a human or synthetic fiber hair extension.

FIG. 5 shows another embodiment of the human or synthetic fiber hair extensions 12 where the sewn end or weft 34 is placed above the first and second tapes, 20, 22 and then cut off at the cut line 36 along with a small length of human or synthetic fiber hair. This allows the use of the human or synthetic fiber hair extensions 12 in places on a user's head that may be more visible. This embodiment may also be more useful in hiding hair extensions 12 on the side of a user's head because the weft 34 is not present.

Figure 6:
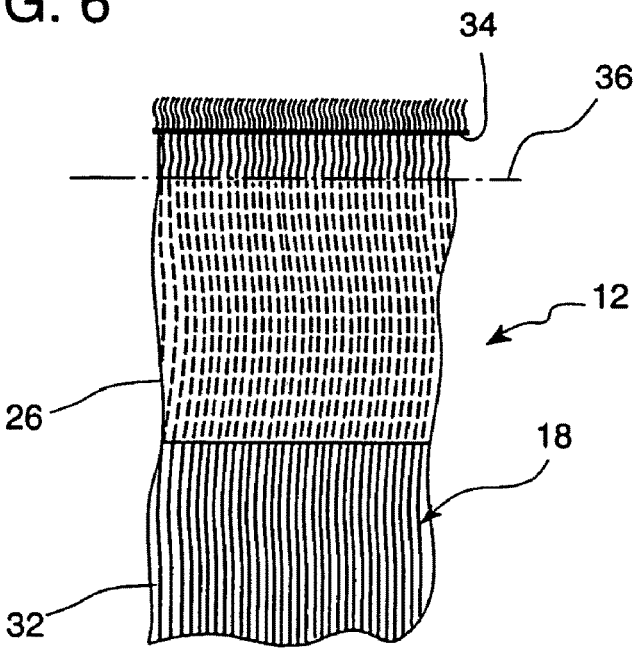
FIG. 6 shows an exaggerated side view of the hair extension of FIG. 5.

FIG. 6 shows a side view of the alternative embodiment in FIG. 5 of the hair extension 12 where the weft or sewn end 34 extends beyond the first and second tapes 20, 22 and the weft 34 and small portion of human or synthetic fiber hair is cut off at the cut line 36, providing better concealment of the human or synthetic fiber hair extensions 12 in the user's natural hair 13.

To remove the hair extension 12, it is suggested that the user begin with the hair extension highest on the head. The natural hair is parted and the upper hair is clipped up. The solvent (not shown) is then sprayed onto the second tape 22 and the first tape 20 or both above and below the human or synthetic fiber hair extensions 12. The solvent is then rubbed into the adhesive on the tapes 20, 22 and the hair extension 12 lifted with a rat tail comb. The natural hair is then removed from the second tape 22. The natural hair attached to the first tape 20 is likewise gently removed and the hair extension 12 removed from the user's head. Clarifying shampoo can then be used to wash the natural hair to remove the solvent and prepare the natural hair for re-application of the hair extensions 12, if desired.

A replacement hair extension 12 (not shown) can have its hair sewn end or weft 34 placed on the mid-line 28 of a new first tape 20, after removal of its cover or liner (not shown), and a new second tape 22, after its cover or liner (not shown) is removed, and the sewn end 34 is then secured to the new second tape 22 at the mid-line 28. Replacement first and second tapes 20, 22 can be used to replace or enhance attachment of the hair extensions 12.

Figure 7:
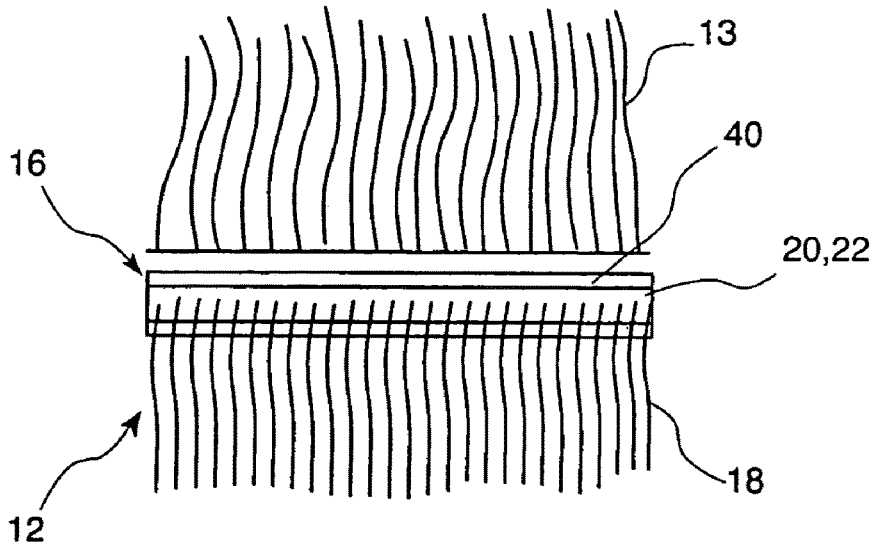
FIG. 7 shows an exaggerated view of another embodiment of a human or synthetic fiber hair extension with the addition of a third tape for use in thicker natural hair applications.
Figure 8:
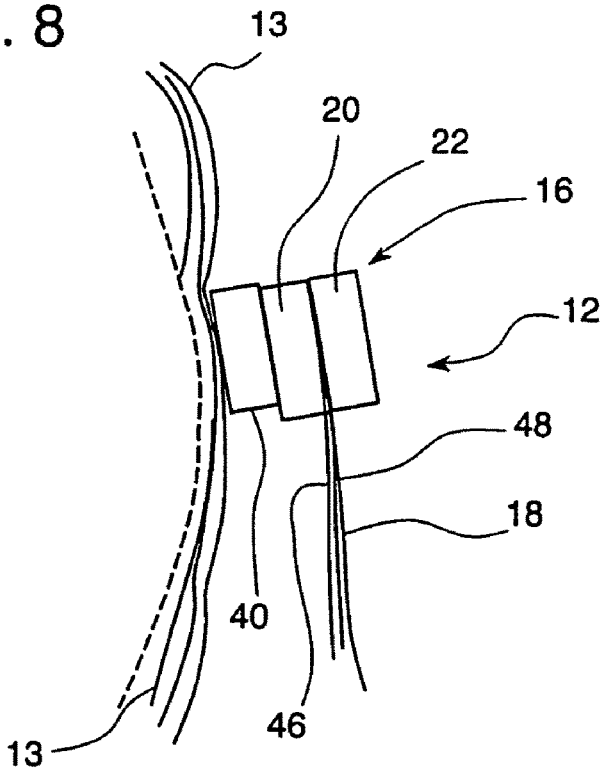
FIG. 8 shows an exaggerated end view of the hair extension embodiment shown in FIG. 7.

FIG. 7 shows another embodiment of hair extension 12. This embodiment can be useful for users that have thick natural hair 13. As shown in FIG. 8, a third tape 40 is affixed to the natural hair 13 at a part line. This third tape 40 has a cover (not shown) that is removed and the third tape 40 is attached to the natural hair 13, as shown in FIG. 8. A second cover (not shown) is removed and the hair extension 12 is affixed to the third tape 40. The first cover (not shown) of first tape 20 of hair extension 12 is removed and hair extension 12 is placed or secured to the third tape 40. The second cover (not shown) of second tape 22 of hair extension 12 is removed and the natural hair 13 above the part line is secured to second tape 22.

This approach works well with users who have thick hair and provides additional securing of the hair extension 12 to a user's natural hair 13.

Figure 9:
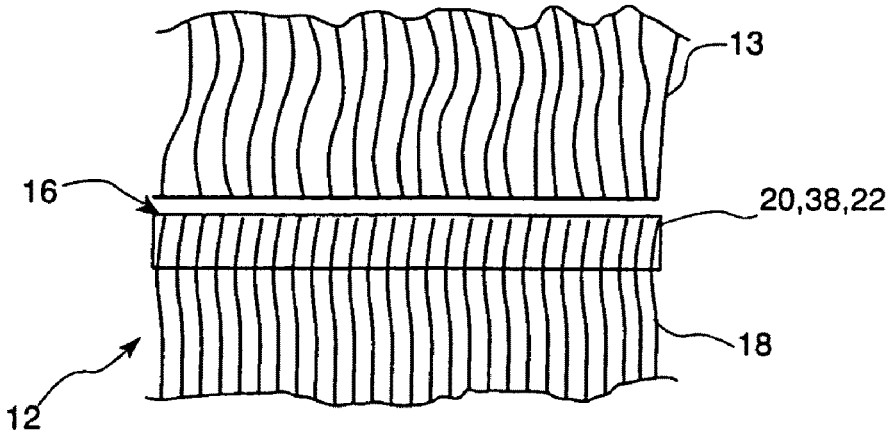
FIG. 9 shows an exaggerated view of another embodiment of a human or synthetic fiber hair extension with a netted backing affixed to the hair and located between first and second tapes.
Figure 10:
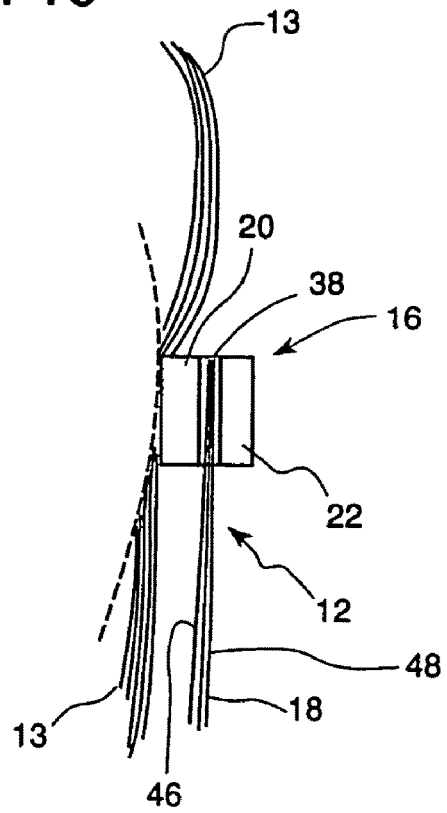
FIG. 10 show an exaggerated end view of the embodiment of FIG. 9.

FIG. 9 shows another embodiment of hair extension 12 secured to a user's natural hair 13. FIG. 10 shows an exaggerated end view of this embodiment. In this embodiment, the hair 18 is secured to a netted backing 38. The netted backing 38 and hair 18 are then sandwiched between first tape 20 and second tape 22. This netted backing 38 helps secure the hair 18. This embodiment of hair extension 12 is attached to the natural hair 13 as has been previously described.

Figure 11:
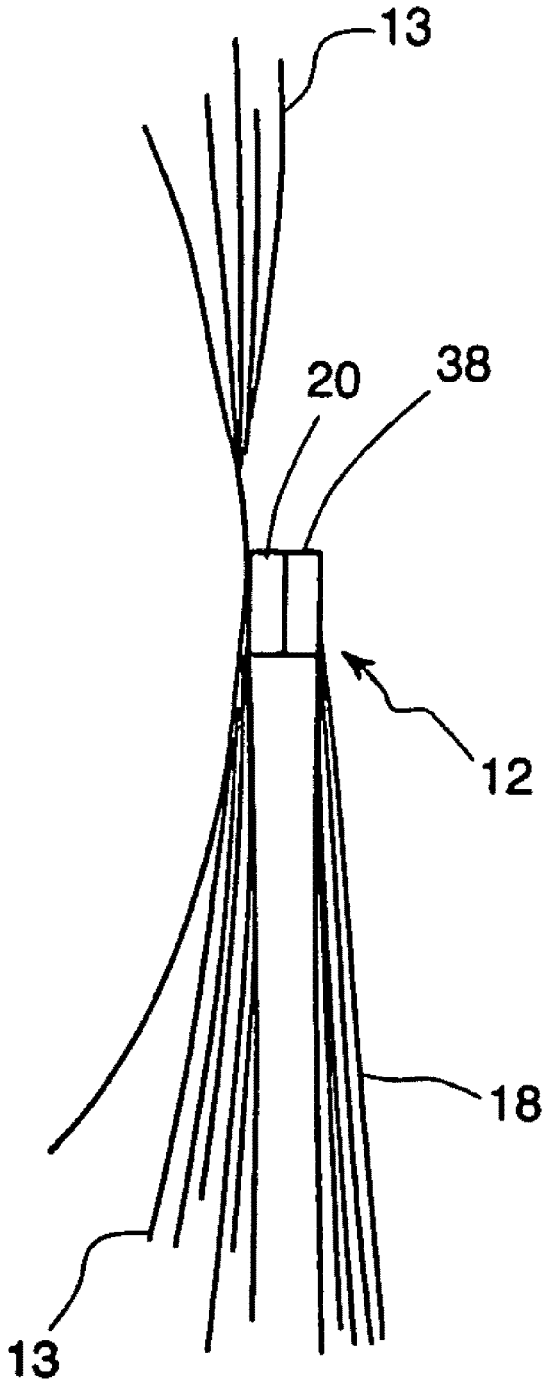
FIG. 11 shows an exaggerated alternative end view of the embodiment of FIG. 10.

FIG. 11 shows an alternative to the embodiments shown and disclosed in FIGS. 9 and 10. FIG. 11 shows an exaggerated end view of a hair extension 12 best used on individuals with thinning hair. In this embodiment, there is shown a first tape 20 affixed to a netted backing 38, which in turn is affixed to hair 18. This embodiment eliminates the use of second tape 22 which may become visible in users with thinning hair, especially those with thinning hair on top of the head. This method can also be beneficial for attaching hair extensions to the bang area of the head.

Figure 19:
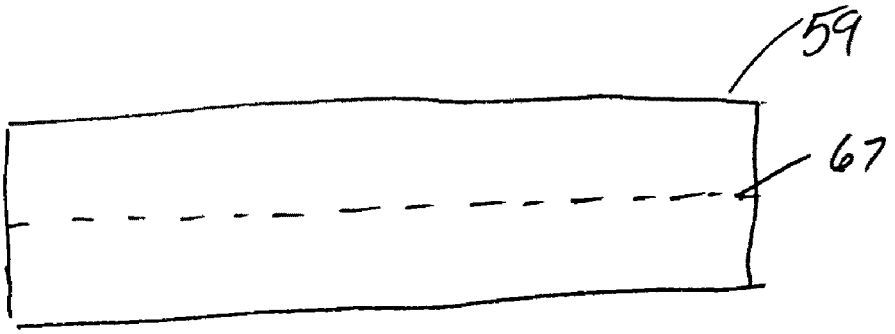
FIG. 19 shows an exaggerated view of another embodiment of tape on the weft or weft-less.
Figure 20:
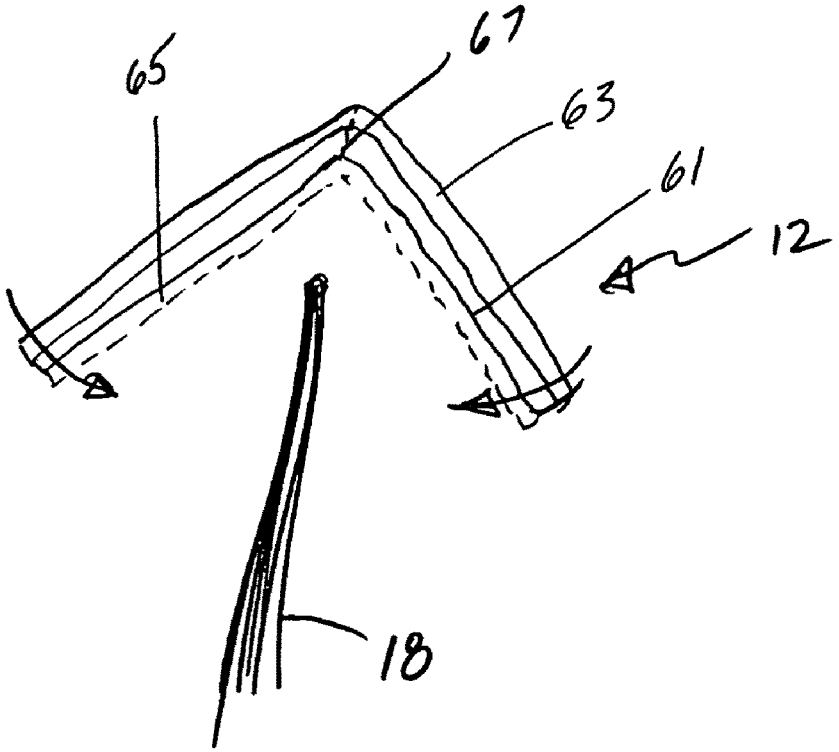
FIG. 20 shows an exaggerated view of an assembly of hair and the tape shown in FIG. 19 to create a hair extension.

FIGS. 19 and 20 show another embodiment of a third tape 61 for use in forming a hair extension 12. Third tape 61 has a third cover 63 on one side and a fourth cover 65 on an opposite side and is generally a wider double-sided tape.

This wider tape 61 can be scored in the center such that the user can remove fourth cover 65 (shown in hidden line) and fold third tape 61 along a center line 67 to affix third tape 61 to the extension's section of hair 18. The third cover 63 can then be removed and the hair extension 12 can be installed as has been previously disclosed.

Figure 12:
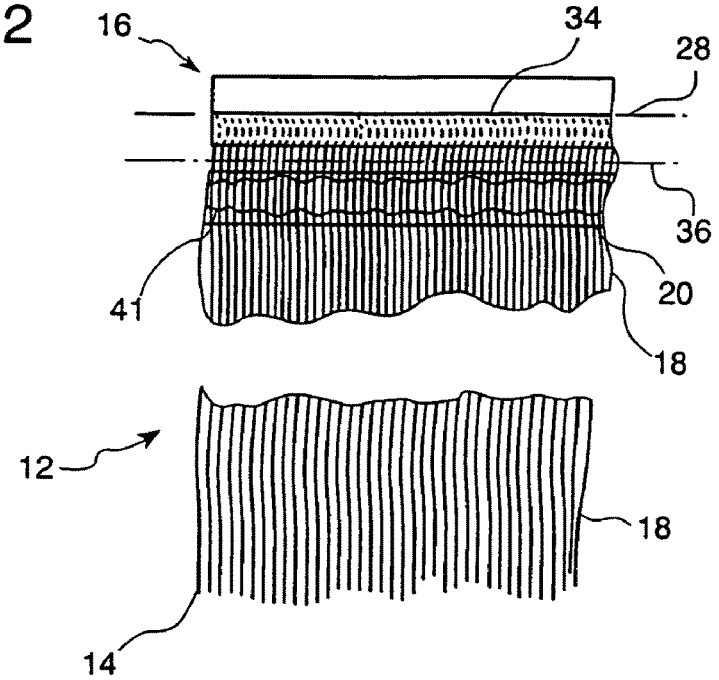
FIG. 12 shows an exaggerated front view of a hair extension with which a user can use glue or adhesive to make the extension weft-less.
Figure 13:
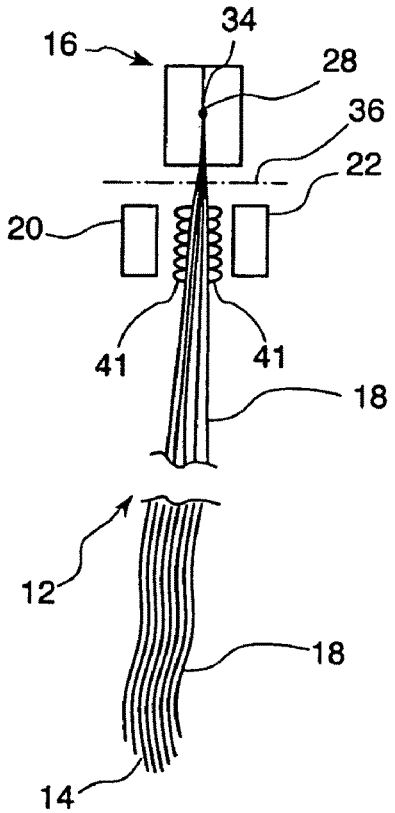
FIG. 13 shows an exaggerated end view of the embodiment shown in FIG. 12.

FIGS. 12 and 13 show exaggerated front and end views of another hair extension 12. This embodiment shows one method of creating a weft-less extension 12. To create a weft-less extension, the user places a bead of adhesive 41 just below the fixed end 16 of the extension and allows the adhesive 41 to dry. The extension 12 is then flipped over and a second bead of adhesive 41 is applied to a corresponding location on the opposite side of the extension 12 and allowed to dry. A first tape 20 and a second tape 22 are then applied over the adhesive 41, one tape on each side. The user can then cut the hair 18 along cut line 36 thus removing the weft 34 from the extension 12. The removal of the weft 34 allows the extension 12 to be used in thinning hair.

Figure 14:
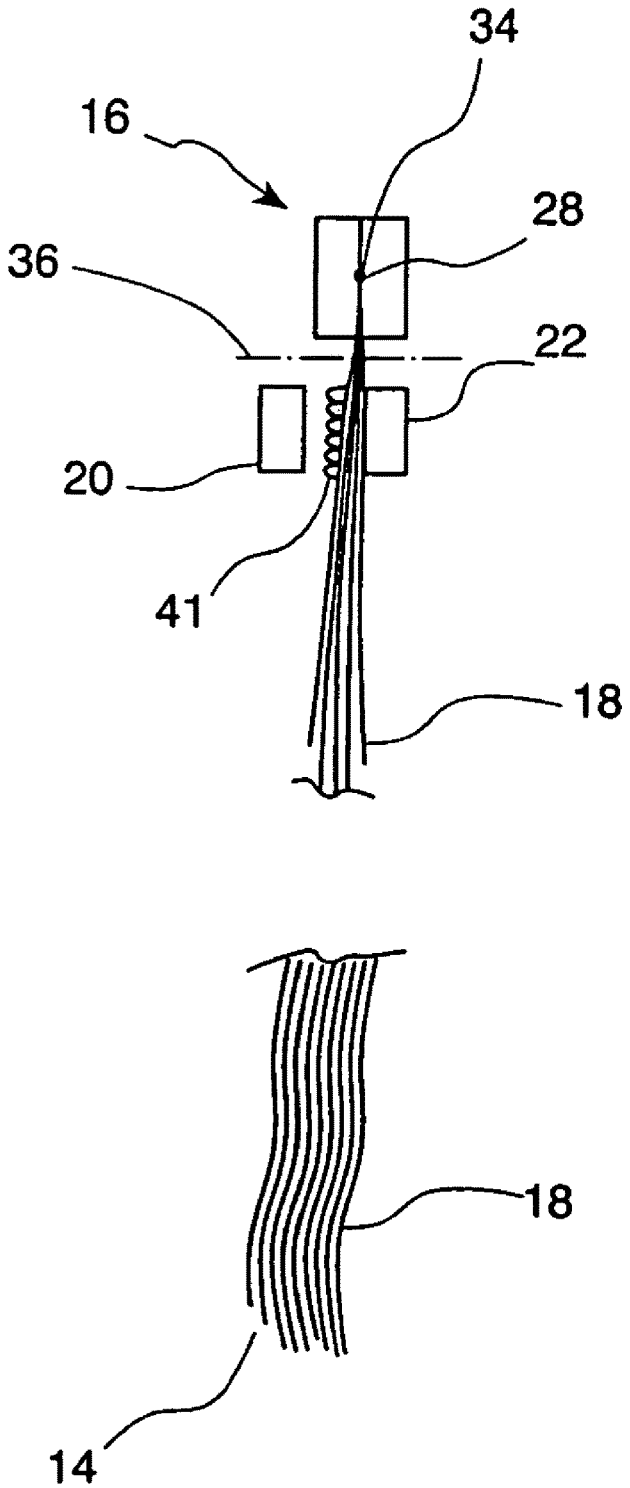
FIG. 14 shows an exaggerated end view of an alternative embodiment of FIG. 13 having one glue or adhesive application to make the extension weft-less.

FIG. 14 shows an alternative embodiment to that shown in FIG. 13. FIG. 14 also shows the removal of the weft 34 from the extension 12, but in this embodiment, only one bead of adhesive 41 is used on one side of the hair 18. The first tape 20 and the second tape 22 are still used as has been previously described to affix the extension 12 to the user's hair.

Figure 15:
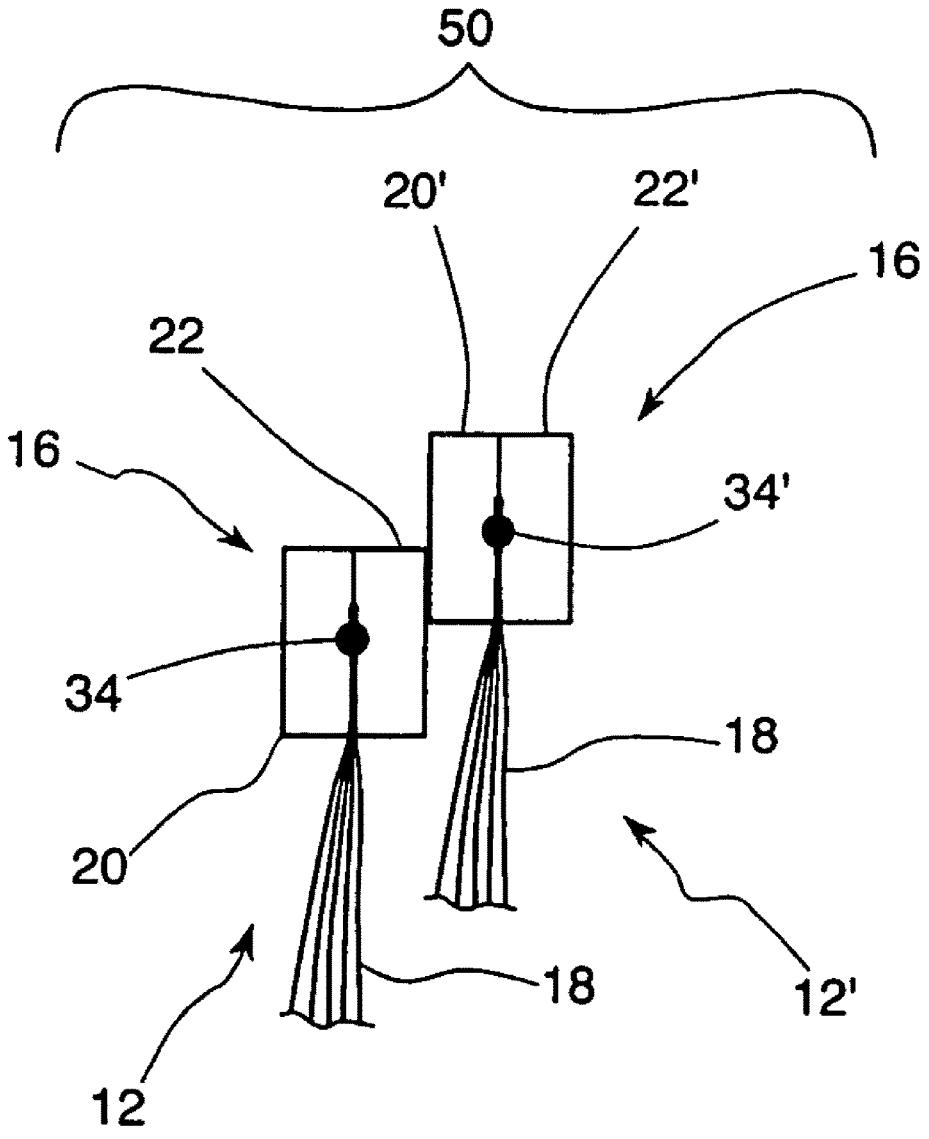
FIG. 15 shows an exaggerated side view of the fixed ends of two extensions combined.

FIG. 15 shows an exaggerated end view of two extensions creating a double extension 50. This double extension 50 may be used for users who have thicker hair or wish to greatly enhance their natural hair. FIG. 15 shows a first extension 12 attached to a second extension 12'. First extension 12 and second extension 12' may be coordinating colors or any color combination that a user may choose. To affix first extension 12 to second extension 12' requires the user to remove the second cover 26 (not shown) from second tape 22 and the first cover 24' (not shown) from first tape 20'. The weft 34' of second extension 12' should be placed above the weft 34 of first extension 12 and the second tape 22 and the first tape 20' secured to one another. This double extension 50 is then ready to be applied to a user's head as has been previously described.

The liquid PU used in these embodiments is a new form of attachment different than that used in the background art.

The background art polyurethane "skin wefts" are mainstream in the hair extension market. They are known as "seamless" in the industry. They are quite different from the embodiments disclosed herein as the embodiments disclosed herein are a brand new form of Liquid Polyurethane (PU) extension.

Background PU skin wefts are denser, heavier, thicker, solid, and the hair is vented into the side of the polyurethane, creating hair on the front side of the extension and "returns" on the back side of the extensions. The background art PU skin wefts, create a solid ridge in the hair which can be felt by the wearer, and by others who may feel the head of the wearer. They also add more weight to the extension, which may cause more tension to the wearer's natural hair, and in some cases may cause a condition called "tension alopecia" or baldness in spots, caused by the weight and tension from the hair extension applied to the wearer's natural hair.

The disclosed liquid PU extensions herein are extremely light weight, paper thin, soft and flexible. The embodiments disclosed are essentially weightless and, when applied correctly, will create virtually no tension on the wearer's natural hair. In addition, there are several different attachment methods that may be used when installing the extensions to lessen the possibility of damage to the natural hair of the user/wearer. Because the present embodiments may be constructed to be paper thin, soft, flexible, and extremely comfortable, they can barely be felt by the wearer or by others. This is a major breakthrough in the hair extension industry.

In the present embodiments, the hair is attached directly into the liquid PU attachment, and therefor has no "returns" on the back side of the attachment as does the background art.

One major problem with background art hair extensions is that they can be clearly felt by the wearer, and by others who may feel the wear's hair. One may feel ridges, lumps, bumps, plastic or metal nubs, thick tracks, or comb clips in the hair. The weight of these background art extensions and the application methods employed by these various types of background art systems, causes them to be less esthetically desirable and much more damaging to the wearer's natural hair.

Background art skin weft extensions come on long strips and need to be cut to fit each application. The present embodiments may be packaged in 3" wide or 1½" wide strips, pre-taped, stacked one above the other, and attached to both sides of a plastic card. The card can have a notch at the top to hang the card from a hook provided with the package. Each strip is simply peeled off the card, the liner is removed, and the extension is attached to the hair. Each card comes enclosed in a package which has complete application directions printed inside with corresponding photographs explaining the installation of these extensions.

The present embodiments disclose liquid PU extensions that are 1½" to 3" wide and include approximately ¼" liquid PU strips, with rounded corners and no shine to moderate shine, with tape applied to one side. The hair in the present embodiments can be a solid color, highlighted colors, or piano stripe colors, and can be applied in any of these various color combinations.

Additional embodiments can include extensions that are 1½" to 3" wide and include ¼" to ½" liquid PU strips with rounded corners, and have tapes applied to both sides of the extensions. Hair in these embodiments can likewise be a solid color, highlighted colors, piano stripe colors or "reversible colors," or have one color on one side of the extension and a different or corresponding color on the opposite side of the extension as has been discussed above.

Figure 21:
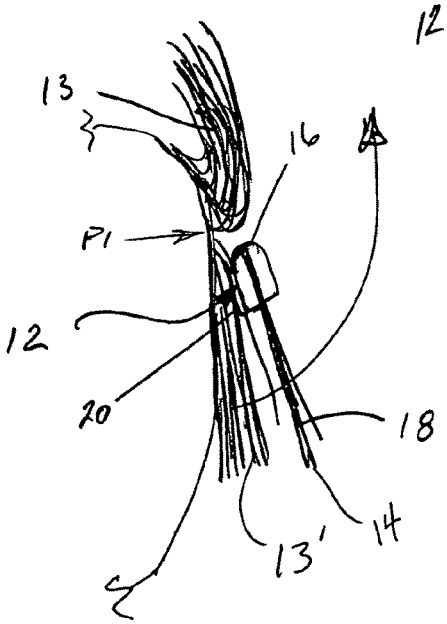
FIG. 21 shows an exaggerated end view of another embodiment of a hair extension attached to human hair.
Figure 22:
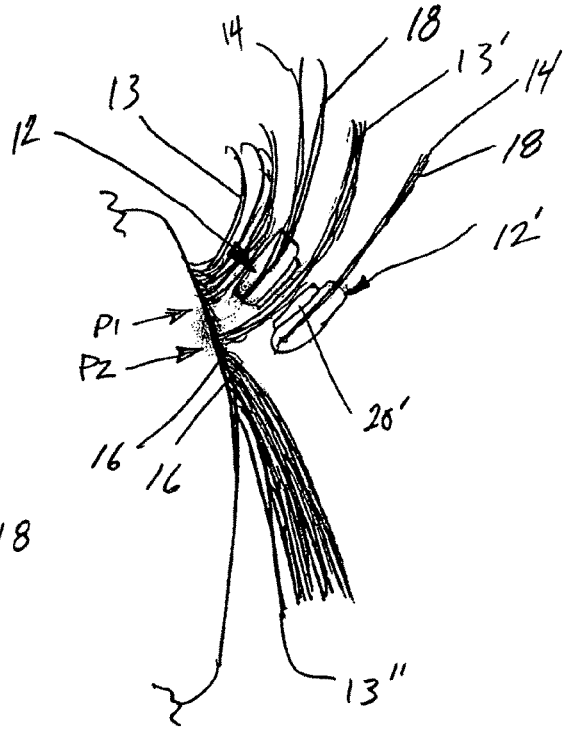
FIG. 22 shows an exaggerated end view of another embodiment of two hair extensions attached to human hair.

FIGS. 21 and 22 show another embodiment and attachment method for hair extensions 12 and 12'. In FIG. 21, the hair 13 is parted at part P1 and lifted and retained. The first tape cover 24 (not shown) is removed and hair extension 12 is firmly pressed with first tape 20 below part P1 to natural hair 13'. Hair extension 12 and natural hair 13' are then lifted up forming part P2. Part P2 is then cleared of any stray natural hair 13 leaving a clean part P2. This allows hair extension 12' to be adhered with first tape 20' to natural hair 13' and aligned end to end with hair extension 12. The two extensions 12 and 12' are then pressed together firmly. The hair extensions 12 and 12' together with natural hair 13, 13' and hair 18 are then lowered providing a sandwich like attachment of extensions 12 and 12'.

These embodiments can likewise have the polymer or liquid PU 55 and first tapes 20, 20' colored to match or co-ordinate with the hair 18 of the extensions 12 and 12'. Likewise, the corners of the fixed end 16 can have rounded corners 57 to lessen the chance of feeling the extension 12 or 12' when installed. The liquid PU 55 can be manufactured having no shine to moderate shine to hide better in the user's natural hair 13 and 13'.

It should be understood that the converse to the method of hair extensions installation disclosed in FIGS. 21, 22 is also anticipated. This method could be reversed wherein extension 12 is installed as has been discussed and instead of pulling extension 12 up, the natural hair 13 above the installed extension 12 is lowered and a part (not shown) made above natural hair 13 wherein extension 12' is affixed in the manner shown in FIG. 22 on top of extension 12 creating the dual extension 12, 12' sandwich method of installation.

Figure 23:
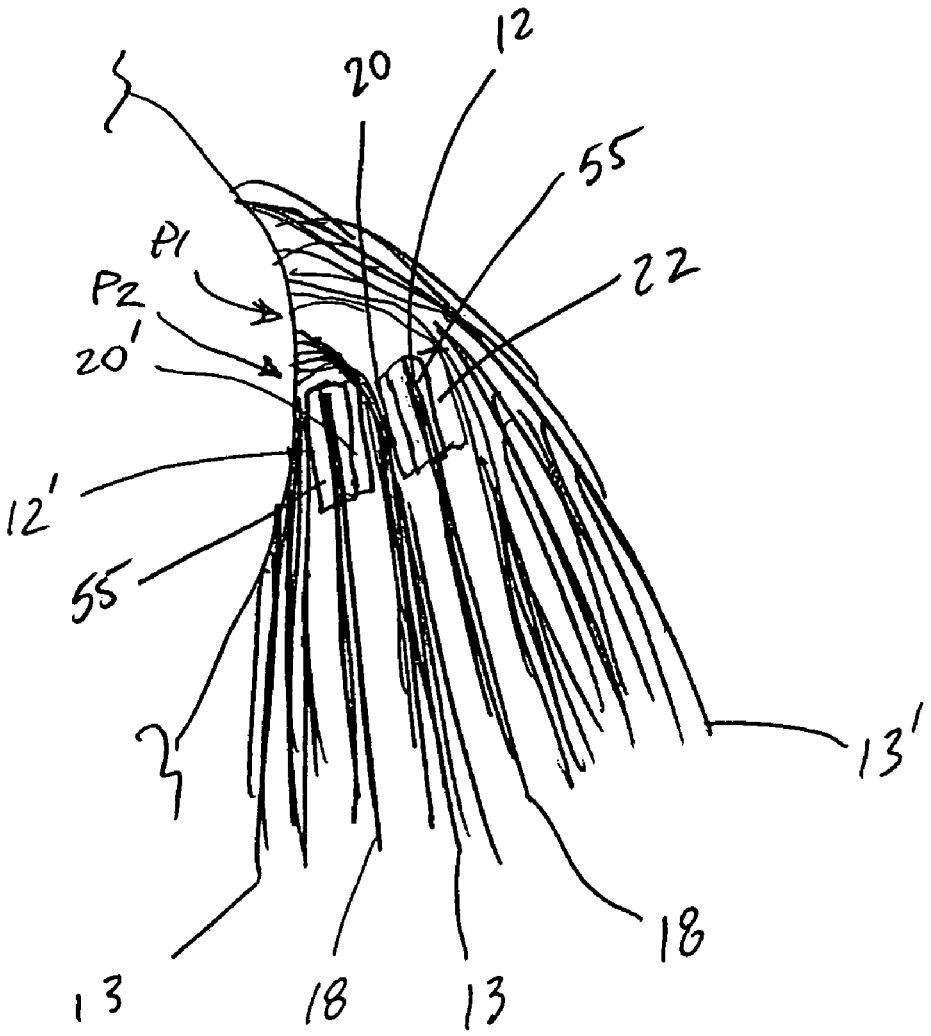
FIG. 23 shows an exaggerated end view of another embodiment of two hair extensions attached to human hair.

Another embodiment is shown in FIG. 23. FIG. 23 shows two hair extensions 12, 12' attached to a user's natural hair 13, 13'. In this embodiment, a part P1 is made and the first cover 24 (not shown) is peeled from first tape 20 and hair extension 12 is attached to the user's natural hair 13. Extension 12 and hair 13' are then lifted to form part P2. P2 is then cleared of any hair 13' leaving a clean part P2 creating a good surface for the attachment of hair extension 12'. Extension 12' is installed end to end matching hair extension 12 with natural hair 13 between the first tapes 20, 20'. Extensions 12 and 12' are pressed together firmly.

First part P1 is made again and second tape 24 with cover 26 is secured to extension 12. Second cover 26 (not shown) is peeled off and hair 13' is allowed to drop onto second tape 22 where it is pressed firmly to second tape 22 and secured.

This embodiment uses two extensions 12' and 12, and hair extension 12 uses two tapes 20, 22 to secure it to hair extension 12' and natural hair 13, 13'. This embodiment essentially has one extension with tape on one side and a second extension with tapes on two sides.

It should be understood that hair extensions 12 and 12' can be removed and the tapes 20, 22, 20' can be replaced. This allows the extensions 12 and 12' to be removed and re-applied. These replacement tapes 20, 22, 20' likewise can be color matching to the polymer 55 or liquid PU and the hair 18, or the replacement tapes 20, 22, 20' may be clear and provided in rolls. As has been previously discussed, these extensions 12 disclosed herein can have a single color hair 18, or the hair 18 may be multi-colored, piano stripe colors, highlighted, have one color on one side and another color on the other side, or be a blended color.

These hair extension embodiments can have a width of approximately 1½" to 3" and include polymer 55 that is approximately ¼" to ½" wide.

Figure 16:
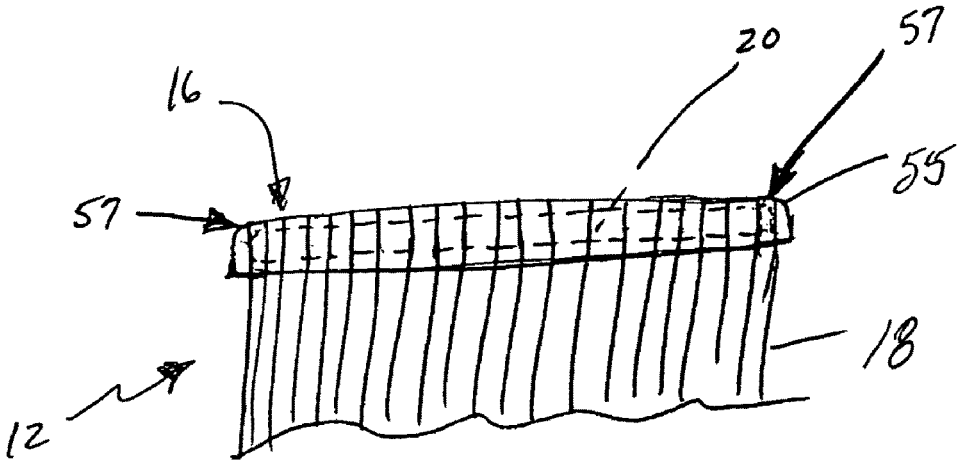
FIG. 16 shows an exaggerated front view of another embodiment using a polymer such as liquid polyurethane or liquid PU to hold the hair in the hair extension with a single piece of tape for bonding to the users head.

FIG. 16 shows an exaggerated front view of another embodiment of the hair extension 12. In this embodiment, the hair 18 is fixed into a receiver (not shown) and a polymer 55, by way of example only, liquid polyurethane or liquid PU, is poured onto the hair 18 retaining the hair in the polymer 55 for attachment to the user. This embodiment of hair extension 12 has rounded corners 57 on each of the ends of the fixed end 16. The polymer 55 and first tape 20 can match the color of the hair 18 or can be clear. This embodiment of hair extension 12 uses a single tape first tape 20 and first cover 24. One preferred width of this hair extension 12 is approximately 1½" to 3" and having a polymer height of approximately ¼" with no shine to moderate shine on the surface of the liquid PU or polymer 55. The low shine or no shine liquid PU or polymer 55 can help hide the extensions 12 in the user's natural hair 13. The second tape 22 can be added to the extension 12 once it has been attached to the natural hair 13. Second tape 22 is applied to the polymer 55 or liquid PU, second cover 26 is removed, and the natural hair 13 is dropped and secured to second tape 22 and pressed together firmly.

Separate tapes or additional tapes can be provided with this embodiment and the others disclosed in this application. These supplemental tapes can be used to enhance the securement of single extension 12 to the user. These supplemental tapes can also be used if the extensions 12 are removed and then re-attached.

Figure 17:
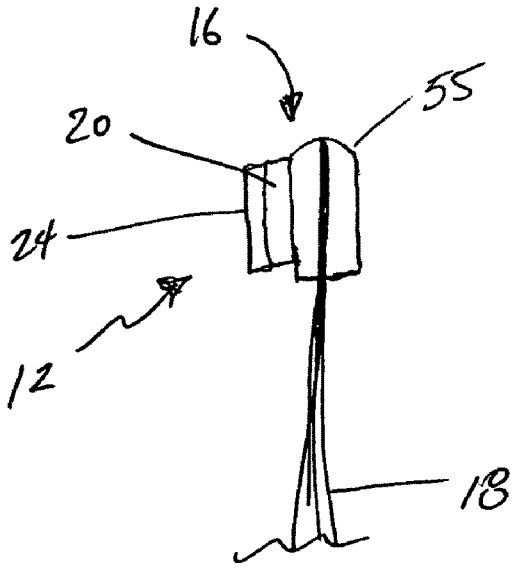
FIG. 17 shows an exaggerated end view of the embodiment shown in FIG. 16.

FIG. 17 shows an exaggerated end view of the embodiment in FIG. 16. It can be seen that the hair 18 is retained within polymer 55, to which is attached first tape 20 with first cover 24 or liner. The first cover 24 is removed and the first tape 20 is used to attach the hair extension 12 to the user's natural hair as has been previously described. The polymer 55 is relatively soft, paper thin, pliable, and has rounded corners 57 so that the wearer can barely feel or not feel at all the hair extension 12 when attached. The polymer 55 is also exposed on both sides of the hair 18 as illustrated in FIG. 17. The height of the polymer 55 in this embodiment can be approximately ¼". This attachment 12 is and feels completely seamless and has been designed so that the wearer will not feel the attachment in their head. It is lighter and causes less stress to the natural hair 13, and no one will feel the extension being worn as it feels like nothing at all is in the natural hair 13.

Second tape 22 (not shown) with second cover 26 could be added to the polymer 55 or liquid PU to the side opposite first tape 20 and first cover 24 as has been described above.

Figure 18:
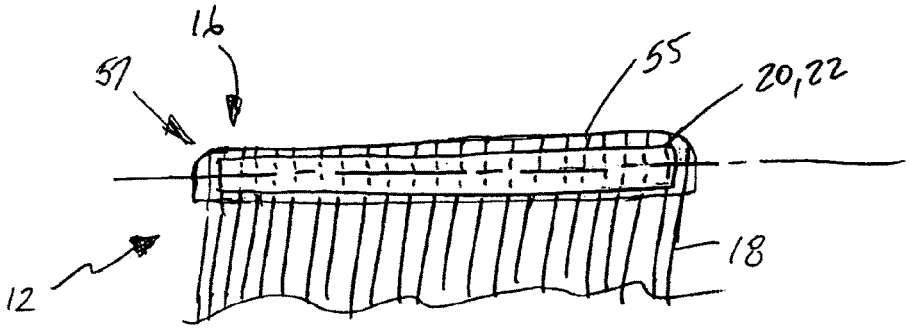
FIG. 18 shows an exaggerated alternative embodiment of a hair extension with rounded liquid PU corners.

FIG. 18 shows an alternative embodiment of hair extension 12 with rounded corners 57 and weft-less hair 18. These rounded corners 57 lessen the chances of snagging hair implements or the user feeling the hair extensions 12 when installed. Obviously, rounded corners can be used with the other embodiments disclosed in this application. In this embodiment, the polymer 55 or liquid PU and tapes 20, 22 can be colored the same or corresponding color to the hair 18. This extension 12 can be attached to the natural hair 13 with the first tape 20 as has been previously described. The second cover 26 from the second tape 22 can then be removed and the natural hair 13 above the part can be lowered and affixed to second tape 22. This embodiment likewise can be manufactured with a polymer height of approximately ¼" to ½" and an extension width of approximately 1½" to 3".

This embodiment of hair extension 12 is extremely thin, has no weft, and has rounded corners. As a result, this hair extension 12 embodiment is soft, pliable and there is virtually no shedding from the extension 12.

Figure 24:
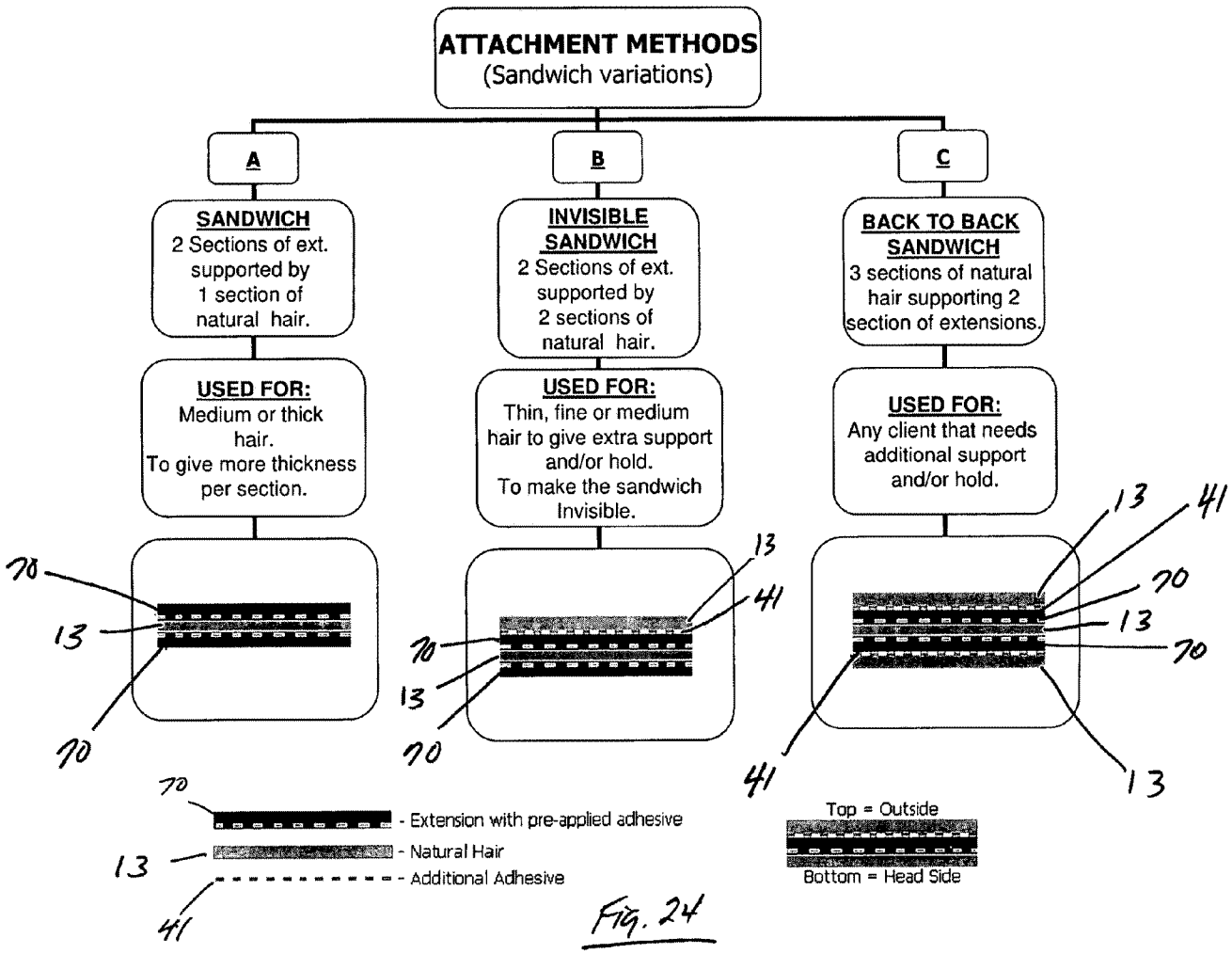
FIG. 24 shows a flow chart of various methods of applying extensions to different types of hair.

FIG. 24 shows various methods for attaching hair extensions 70 to a user's head. FIG. 24 specifically shows variations of the "sandwich" method. Three variations are shown in FIG. 24. The "A" method can be used for persons having medium or thick hair. In this method, two extensions 70 having pre-applied adhesive on one side of each extension are affixed to the user's natural hair 13, in essence sandwiching the user's natural hair 13.

The "B" method can be used on thin, fine or medium natural hair and utilizes two extensions 70 with pre-applied adhesive. This method can also be beneficial for use where the hair parts, near a cowlick, or with shorter layered hair. The natural hair 13 is sandwiched in between with the addition of adhesive 41 on the second side of one extension 70 for adhering to another section of the user's natural hair 13.

The "C" method can be used for users that need additional support or hold and involve two extensions 70 with pre-applied adhesive on a first side. The addition of adhesive 41 to the second side of each extension 70 is used for affixing additional sections of the user's natural hair 13. This essentially sandwiches the user's natural hair 13 between two extensions 70 with pre-applied adhesive on a first side of the extension and additional adhesive 41 applied to the second side of each extension 70.

Figure 25:
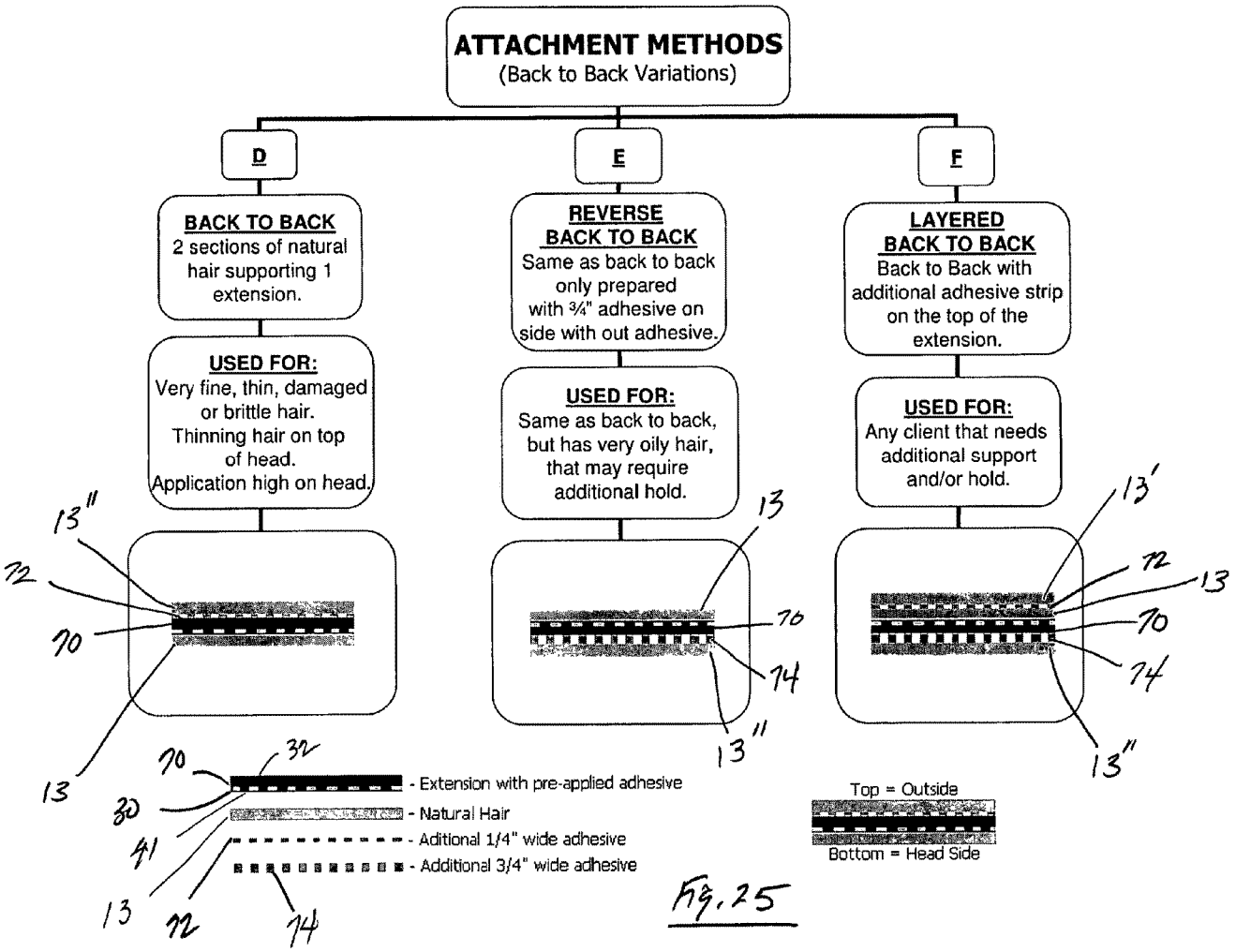
FIG. 25 shows a flow chart of various methods of applying extensions to different types of hair.

FIG. 25 shows another flow chart showing various methods of hair attachment that can be used for various permutations of desired hair and hair types. FIG. 25 shows a variation to the methods shown in FIG. 24.

The methods shown in FIG. 25 use a single extension 70 with adhesive pre-applied to a first side 30 with the addition of either a narrow adhesive 72 or a wide adhesive 74 applied to the second side 32.

The "D" method shows an extension 70 and natural hair 13 attached to the first side 30 of extension 70. The second side 32 of extension 70 has a narrow adhesive 72 applied and then a second piece of natural hair 13". This method can be used for users who have very fine, thin damaged, brittle hair or for application high on the users head.

Method "E" can be used for a wide variety of hair, but is especially beneficial to those having very oily hair that may benefit from the additional hold of the wide adhesive 74.

The extension first side 30 is affixed to the user's natural hair 13 and a wide adhesive 74 is attached to the second side 32 of extension 70 where a second strip of natural hair 13" is then attached.

Method "F" can be applied to users who require additional support or hold. Method "F" is applied where the natural hair 13 is affixed to the pre-applied adhesive on the first side 30 of extension 70. The other side of this natural hair 13 is applied a narrow adhesive 72 and an additional strip of natural hair 13' is then applied to the other side of a narrow adhesive 72.

The second side 32 of extension 70 has a wide adhesive 74 applied to which another strip of natural hair 13" is affixed.

Figure 26A:
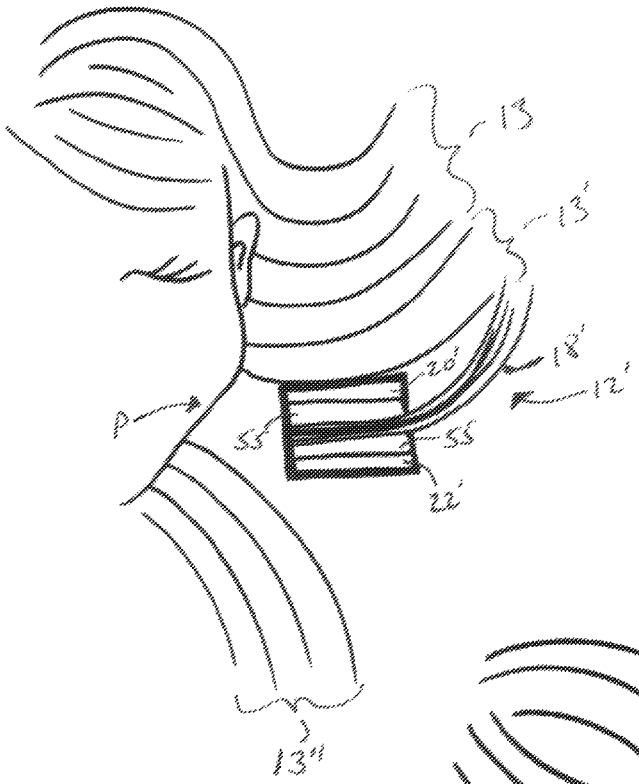
FIGS. 26A-26B illustrate, in exaggerated format, an additional alternative process for attaching hair extensions, such as the extensions generally illustrated in FIGS. 16-17, to natural hair of a user.
Figure 26B:
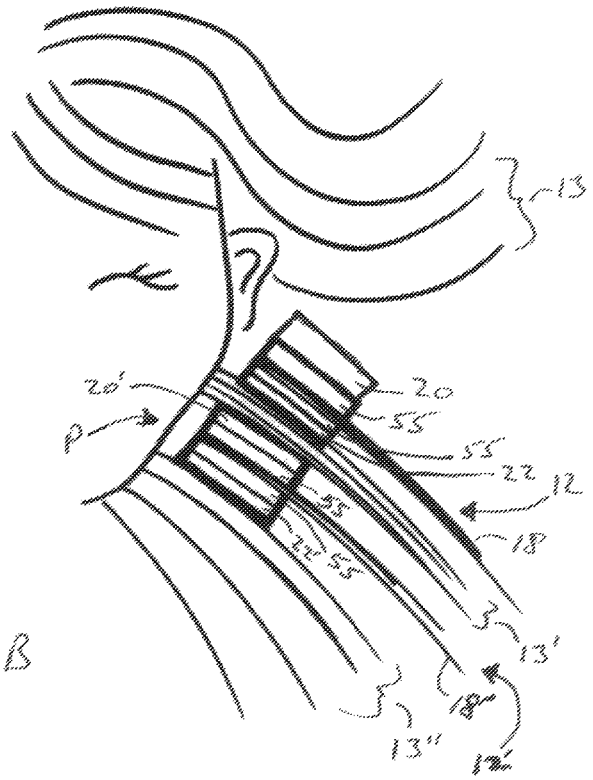
Figure 27:
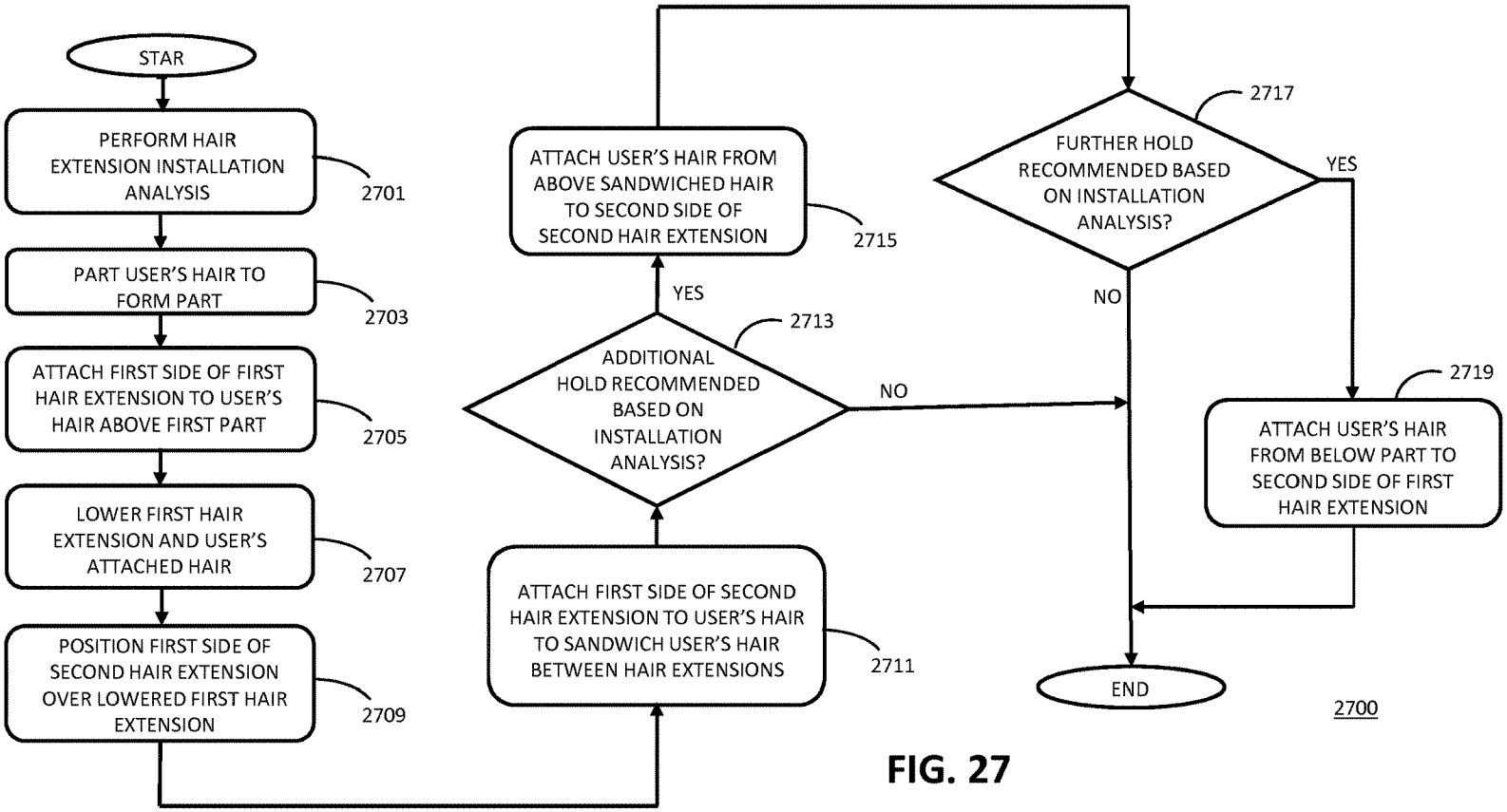
FIG. 27 is a flow diagram of steps performed by a hair extension installer (e.g., a user or a stylist) to attach hair extensions to natural hair of a user according to the process illustrated in FIGS. 26A-26B.

Additional alternative methods for attaching one or more hair extensions to a user's natural hair are illustrated in FIGS. 26-29. FIGS. 26A-B and 27 illustrate alternative methods for creating the attachment configurations discussed above with respect to Methods "A" through "C" of FIG. 24. FIGS. 28A-C and 29 illustrate a method for providing additional hair extension support when Method "D" of FIG. 25 is used as the base method of attachment.

Referring now to FIGS. 26A-B and 27, a hair extension installer (e.g., the user/wearer, a stylist, or anyone else assisting the user with installation of the user's hair extensions 12, 12') may produce the hair extension attachment configuration shown for Method "A" of FIG. 24 by reversing the order in which the attachment process takes place. For example, instead of first parting the user's hair to form part P1 as shown in FIG. 21, the installer may part (2703) the user's hair to first form a part P, which would be at the position of part P2 as shown in FIG. 22. The formed part may be horizontal or at an angle relative to horizontal, as desired by the user and/or the installer. Extraneous hair 13', 13" from above and/or below part P may be cleared using a comb, such as a rat tail comb, to leave a clean part P. The installer may retain the user's hair 13, 13' above part P by clipping it together with a hair clip 11, such as illustrated in FIG. 1.

After the user's hair has been parted, the installer attaches (2705) one side of hair extension 12' to the user's natural hair 13' above part P. A double-sided adhesive tape 20' is preferably pre-attached to one side of the hair extension's section of hair 18', proximate the affixed-together end of the hair extension 12', thereby forming part of the hair extension 12'. Alternatively, the adhesive tape 20' may be a separate component and attached to the hair extension's section of hair 18' by the installer at or about the time of installation to effectively form a new extension. With the tape 20' applied, the installer firmly presses the exposed side of the tape 20' against the natural hair 13' of the user to attach the extension 12'. The installer may use a comb, such as a rat tail comb, to assist with pressing the hair 13' onto the tape's adhesive. The adhesive tape 20' may be clear or colored, as so desired by the user. If the tape 20' is colored, the color may be chosen so as to generally match the color of the user's natural hair 13', to generally match the color of the hair extension's section of hair 18', or to make a fashion statement as desired by the user.

According to a more preferable embodiment, the hair extension's hair 18' is affixed together at one end using a solidified liquid polymer 55 that holds the hair 18 of the extension 12' together and is exposed on both sides of the extension 12' to provide surfaces upon which to apply adhesive or adhesive tape 20', 22', as discussed above with respect to FIGS. 16-22. Similar to the adhesive tape 20', the polymer 55 may be colored to match the user's hair color, the extension's hair color, or the user's fashion desires. The adhesive tape 20' may be attached to the exposed polymer 55 on the applicable side of the extension 12'. For example, as illustrated in FIG. 16, the adhesive tape 20' may be covered by a removable liner 24 on each side of the tape 20'. The liner 24 on one side of the tape 20' may be removed to allow the tape 20' to be attached to the polymer 55, or the affixed-together end of the section of hair 18', on the side of the extension 12' to be attached to the user's hair 13'. Alternatively, the tape 20' may be pre-attached to the polymer 55 during manufacturing of the hair extension 12' and the extension 12' may include a removable liner 24 over the exposed side of the tape 20' to prevent the tape 20' from sticking to unintended objects or materials and potentially losing its tackiness. Although shown in extremely exaggerated form in FIGS. 26A-B and 28A-C, the adhesive tapes 20, 20', 22, 22' and the polymer 55, when included, may be very thin, such as on the order of 1/16 inches or less, to maximize comfort for the user/wearer.

After the hair extension 12' has been attached to the user's hair 13' above part P, the installer lowers (2707) the hair extension 12' and the user's attached hair 13'. Lowering of the hair extension 12' may naturally form another part (e.g., such as part P1 in FIG. 22) between the user's hair 13' that is attached to the adhesive 20' and the user's remaining hair 13. Extraneous hair 13, 13' that lowers with the extension 12' and/or is not attached securely to adhesive tape 20' may be cleared using a comb.

After the attached extension 12' and its attached hair 13' have been lowered, the installer positions (2709) one side of a second hair extension 12 over or above the lowered extension 12' and attached hair 13' such that the adhesive tape 20' of the lowered extension 12' and an adhesive tape 22 of the second extension 12 are substantially aligned across a width of the lowered hair extension 12' (and preferably across the substantially matching widths of both extensions 12, 12'). After the second extension 12 has been properly positioned, the installer attaches (2711) the second hair extension 12 to the user's hair 13' attached to the first extension 12' so as to sandwich the user's hair 13' between the two hair extensions 12, 12'. Attachment of hair extension 12 to the user's hair 13' may be performed in a manner similar to attachment of hair extension 12' to the user's hair 13' after part P was formed. For example, hair extension 12 may be pressed against the user's hair 13' such that the extension's adhesive tape 22 proximate the affixed-together end of the extension's section of hair 18 attaches to the user's hair 13'. In a more preferable embodiment, the hair 18 and adhesive tape 22 of the second extension 12 are positioned (2709) to overlay the hair 12' and adhesive tape 20' of the first extension 12' such that the two tapes 20', 22 substantially align across their widths and lengths (e.g., align across 75% or more of their widths and lengths). The length of each adhesive tape 20', 22 is approximately equal to the width of tape's respective extension 12', 12. In other words, hair extension 12 is preferably positioned to directly overlay hair extension 12' to sandwich the user's hair 13' between the two hair extensions 12, 12'. Once hair extension 12 and its adhesive tape 22 are properly positioned, the two adhesive tapes 20', 22 are pressed firmly together to sandwich the user's hair 13' between the two extensions 12, 12'.

Depending on the results of a hair extension installation analysis performed by the installer, one or more of the hair extensions 12, 12' may benefit from additional hold. For example, as discussed above with regard to FIGS. 24-25, hair extensions installed in fine, thin, brittle, damaged, and/or oily hair may need extra hold to keep them installed for a desired amount of time. As a result, the hair extension installer may perform (2701) a hair extension installation analysis to determine whether additional hold may be necessary. To perform the analysis, the installer evaluates the type (e.g., straight, wavy, curly, kinky), condition (e.g., oily, dry, chemically dry (such as from coloring), dandruff, damaged, split ends, alopecia), and texture (e.g., fine, medium, thick) of the user's hair and the desired locations of hair extensions about the user's head, as well as gains an understanding of the user's lifestyle and general appearance preferences. For example, the installer may want to know whether the user sweats regularly (e.g., do to working out), is in the sun or a tanning booth regularly, is regularly exposed to any other conditions that may affect the attachment of the extensions 12, 12' to the user's hair over time, or simply wants to insure that the extensions 12, 12' remain practically invisible under all conditions. The hair extension installation analysis is shown as the first step of the flow diagram 2700 of FIG. 27; however, such an analysis may occur at any time during or before the hair extension installation process.

When the installer determines (2713) that additional hold is recommended for the hair extensions 12, 12', the installer may attach (2715) user hair 13 from above the sandwiched hair 13' to the opposite or top side of hair extension 12 to provide the additional hold. To do so, the installer may apply or place a strip of adhesive, such as a liquid adhesive or, more preferably, double-sided adhesive tape 20, onto the polymer 55 on the top side of the extension's section of hair 18. Alternatively, where the extension 12 includes a pre-attached top side adhesive tape 20, the installer may remove a liner 24 (if included) from the adhesive tape 20 to expose the tape's outer adhesive. After the top side adhesive (e.g., adhesive tape 20) has been applied or exposed, the installer lowers the user's hair 13 from above extension 12 onto the extension 12 and its section of hair 18, and firmly presses the lowered hair 13 onto the top side adhesive of the extension 12 to secure the lowered hair 13 to the top side of the extension's section of hair 18. The installer may use a comb or other instrument to assist with pressing the lowered hair 13 onto and into the top side adhesive. In this manner, the extension attachment configuration described with respect to step 2715 mirrors the configuration shown in FIG. 24 as Method "B," and the user's hair 13 above the sandwiched hair 13' helps support the installed hair extensions 12, 12'.

When the installer determines (2717) that further hold is recommended for the hair extensions 12, 12', the installer may attach (2719) the user's hair 13" from below the part P (and below the sandwiched hair 13') to a bottom side of the bottom extension's section of hair 18'. To accomplish this attachment, the installer may lift the hair sections 18, 18' of the two hair extensions 12, 12' together with the user's attached hair 13, 13' and retain all the hair 13, 13', 18, 18' in an uplifted configuration using a hair clip 11 (e.g., as shown in FIG. 1). With the hair uplifted, the installer may apply or place a strip of adhesive, such as a liquid adhesive or a double-sided adhesive tape 22', onto the polymer 55 on the bottom side of the extension 12'. Alternatively, where the extension 12' includes a pre-attached bottom side adhesive tape 22', the installer may remove a liner 24 (if included) from the bottom side adhesive tape 22' to expose the tape's outer adhesive. After the bottom side adhesive (e.g., adhesive tape 22') has been applied or exposed, the installer lowers the uplifted hair, including the bottom side hair extension 12', onto the user's hair 13" below part P, and firmly presses the bottom side adhesive onto the user's hair 13" to attach or secure the user's hair 13" to the bottom extension's section of hair 18'. In this manner, the extension attachment configuration described with respect to steps 2715 and 2719 mirrors the configuration shown in FIG. 24 as Method "C" and the user's hair 13, 13" above and below the sandwiched hair 13' helps support the installed hair extensions 12, 12'. Alternatively, where the installer performs (2701) the hair extension installation analysis early during the installation process and determines (2713, 2717) that extra hold is recommended, the installer may attach the bottom side of the lower extension 12' to the user's hair 13" below the part P after attaching (2705) the top side of extension 12' to the user's hair 13' above the part P and lowering (2707) the extension 12', with exposed adhesive, onto the user's hair 13" below the part P.

In a further alternative embodiment where the installer determines, based on the hair extension installation analysis, that the attachment configuration of Method "C" of FIG. 24 is recommended, the attachment process for the extensions 12, 12' may be modified and somewhat reversed as discussed above with respect to FIGS. 21-22. According to this embodiment, part P is formed as discussed above, but instead of first attaching extension 12' to the user's hair 13' above the part P, the extension 12' is attached to the user's hair 13" below the part P using, for example, adhesive tape 22'. A thin strip of hair 13' from above the part P is then lowered and pressed firmly onto the top side adhesive tape 20' of extension 12'. Extension 12 is then attached to the top side of user's hair 13' to sandwich the user's hair 13' between the two hair extensions 12, 12' as discussed above. Finally, the user's hair 13 from above the sandwiched hair 13' is lowered and pressed firmly onto the adhesive (e.g., adhesive tape 20) on the top side of extension 12 to create the attachment configuration of Method "C" of FIG. 24.

Referring now to FIGS. 28A-C and 29, a hair extension installer may attach a hair extension 12 to a user's natural hair generally according to Method "D" as shown in FIG. 25 and described above, but with a special modification to provide additional hold for the hair extension 12. According to this attachment embodiment, the installer parts (2903) the user's hair to form a part P and attaches (2905) the bottom side of a hair extension 12 to the user's hair 13' below the part P, as shown in exemplary and exaggerated form in FIG. 28A. Extraneous hair 13, 13' from above and/or below part P may be cleared using a comb to leave a clean part P. The bottom side of the extension 12 includes an adhesive tape 20 (e.g., a double-sided adhesive tape) with one side attached to the bottom side of the extension's section of hair 18 and the other side being attachable to an object, such as the user's hair 13' below the part P. The adhesive tape 20 may be applied by the installer to the extension's hair 18 or , more preferably, to an exposed portion of the polymer 55 affixing the extension's hair 18 together proximate one end of the extension 12, as discussed above with respect to FIGS. 26A-B and 27. Alternatively and more preferably, the adhesive tape 20 may be pre-attached to the extension's hair 18 or the exposed polymer 55 at the time the extension 12 is manufactured. In the latter case, a removable liner 24 may be included to cover the adhesive on the exposed side of the adhesive tape 20 until such time as the extension 12 is installed in the user's hair 13.

After the bottom side of the extension 12 has been attached to the user's hair 13' below the part P, the installer attaches (2907) the user's natural hair 13 from above the part P to the top side of the hair extension 12 using adhesive tape 22. The installer may do so by attaching the user's hair 13 from above the part P to the adhesive tape 22 on the top side of the hair extension 12, as shown in exemplary form in FIG. 28B. Such attachment may occur by lowering the user's hair 13 above the part P onto the extension's top side adhesive tape 22 and pressing the user's hair 13 firmly onto the tape 22. The installer may use a comb to assist with pressing the user's hair 13 onto the tape 22. The top side adhesive tape 22 may be identical to the bottom side adhesive tape 20 and may be applied upon the extension's hair 18 or the exposed polymer 55, as applicable, at the time of hair extension installation (e.g., before lowering the user's hair 13 onto the extension 12). Alternatively and more preferably, the top side adhesive tape 22 is pre-attached to the exposed polymer 55 or otherwise on the top side of the extension's hair 18 at the time of hair extension manufacture. In such a case, a removable liner 24 may be included to cover the adhesive on the exposed side of the adhesive tape 22 until such time as the extension 12 is installed in the user's hair 13.

Figure 28A:
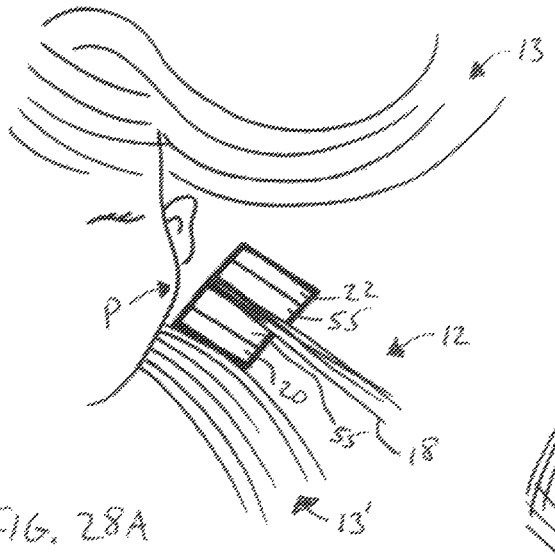
FIGS. 28A-28C illustrate, in exaggerated format, yet another alternative process for attaching a hair extension, such as that generally illustrated in FIG. 17, to natural hair of a user.
Figure 28B:
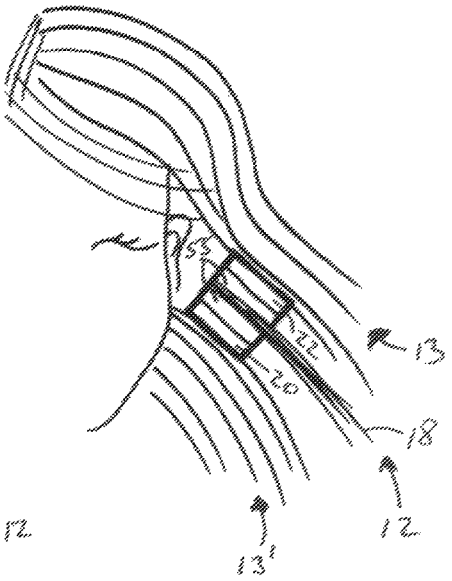
Figure 28C:
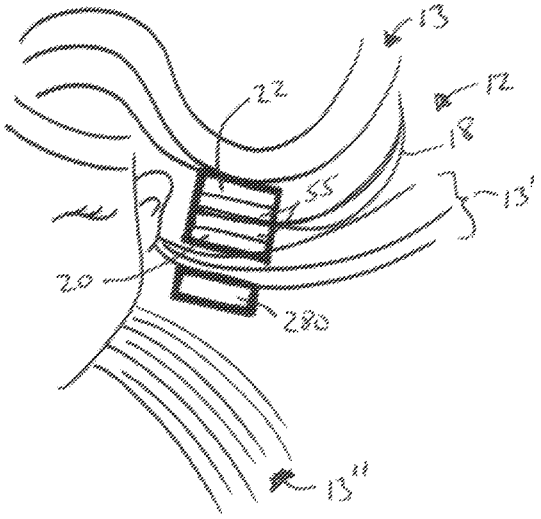
Figure 29:
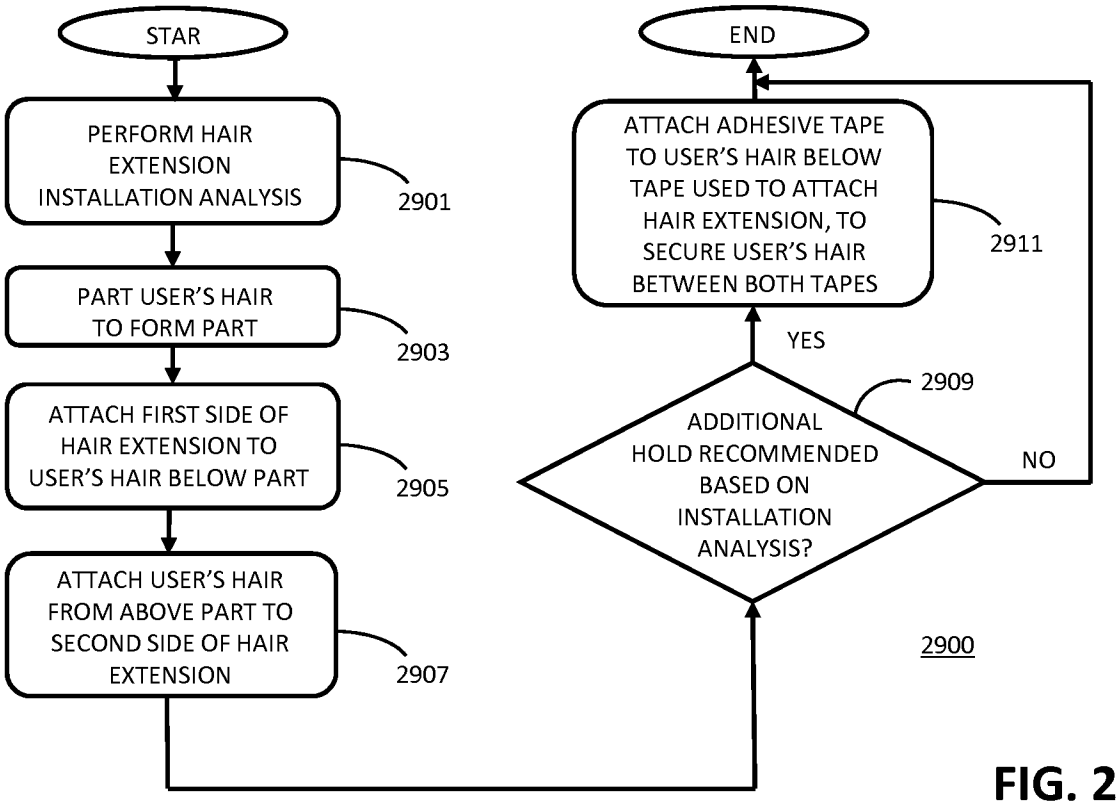
FIG. 29 is a flow diagram of steps performed by a hair extension installer to attach a hair extension to natural hair of a user according to the process illustrated in FIGS. 28A-28C.

The attachment procedure reflected in steps 2903-2907 of FIG. 29 and illustrated in FIGS. 28A-B results in the attachment configuration identified as Method "D" in FIG. 25. However, certain users may require additional hold for their hair extensions 12 due to a variety of factors, such as a user's lifestyle, the location of a hair extension about a user's head, and/or a type, condition, and/or texture of a user's hair. The additional hold can be provided by attaching (2911) another adhesive tape 280 beneath or below the bottom-side tape 20 of the extension 12 so as to secure or seal the user's hair 13' between the two pieces of tape 20, 280, as illustrated in FIG. 28C. In this embodiment, the seal tape 280 is preferably single-sided (i.e., includes adhesive on only one side) and the adhesive side of the tape 280 is attached to the user's hair 13' below the bottom adhesive tape 20 of the hair extension 12. In an alternative embodiment, the seal tape 280 may be double-sided and also be attached to the user's hair 13" below the hair 13' being sealed. The seal tape 280 is preferably positioned directly below the bottom tape 20 of the extension 12 and aligned substantially end to end with the bottom tape 20 of the extension 12 across all or most of a width of the extension 12 (e.g., aligned across 75% or more of the extension's width). In other words, the seal tape 280 is preferably positioned to lay directly underneath the extension's bottom tape 20 to secure the user's hair 13' between the two tapes 20, 280 when the two tapes 20, 280 are pressed firmly together. The seal tape 280 is preferably at least as wide as the bottom tape 20 of the extension 12 and may be wider for certain hair types, such as oily hair types, and/or user lifestyles (e.g., where a user regularly sweats).

The decision to use the seal tape 280 may be made by the installer based on performing (2901) a hair extension installation analysis as discussed above with regard to step 2701 of FIG. 27. Where, based on such an analysis, the installer determines (2909) that additional hold for the extension is recommended, the installer may attach (2911) the seal tape 280 as detailed above. As an example, oily hair types and user lifestyles involving regular sweating may benefit from use of the seal tape 280 to provide additional hold. The hair extension installation analysis is shown as the first step of the flow diagram 2900 of FIG. 29; however, such an analysis may occur at any time during or before the hair extension installation process.

The foregoing disclosure describes various hair extension configurations and methods for installing hair extensions in a user's/wearer's hair based on the individual needs of the user, including based on the user's hair type, condition, and/or texture, the extension's location about the user's head, and/or the user's lifestyle. The disclosed methods provide processes for attaching hair extensions to a user's hair so as to provide the appropriate hold, while mitigating damage to the user's hair.

In the foregoing specification, the present invention has been described with reference to specific embodiments. However, one of ordinary skill in the art will appreciate that various modifications and changes may be made without departing from the spirit and scope of the present invention as set forth in the appended claims. Accordingly, the specification and drawings are to be regarded in an illustrative rather than a restrictive sense, and all such modifications are intended to be included within the scope of the present invention.

Benefits, advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential features or elements of any or all the claims. The invention is defined solely by the appended claims and all legally-permissible equivalents of those claims and/or their constituent steps or elements as issued.

What is claimed is:

1. A method for attaching a hair extension to natural hair of a user, the hair extension including a section of hair and a first adhesive tape, the section of hair being affixed together at one end, the first adhesive tape being attached to a first side of the section of hair proximate the affixed-together end of the section of hair, the method comprising:

parting natural hair of the user to form a part;

attaching the first adhesive tape of the hair extension to a first layer of natural hair of the user below the part;

attaching a second layer of natural hair of the user from above the part to the hair extension using a second adhesive tape; and attaching a third adhesive tape to the first layer of natural hair such that the third adhesive tape is positioned below the first adhesive tape and the first layer of natural hair is sealed between the third adhesive tape and the first adhesive tape.

2. The method of claim 1, wherein the third adhesive tape is positioned directly below and is substantially aligned with the first adhesive tape across at least 75% of a width of the hair extension.

3. The method of claim 1, wherein:

the section of hair is affixed together at one end by a solidified liquid polymer;

the polymer is exposed on the first and second sides of the section of hair;

the first adhesive tape is attached to the polymer exposed on the first side of the section of hair; and the second adhesive tape is attached to the polymer exposed on the second side of the section of hair.

4. The method of claim 1, further comprising:

determining at least one of a type, a texture, and a condition for natural hair of the user;

wherein the step of attaching the third adhesive tape is performed when the natural hair of the user is determined to be at least one of a type, a texture, and a condition that would benefit from additional hold for the hair extension.

5. The method of claim 1, wherein the second adhesive tape is part of the hair extension and is attached to a second side of the section of hair proximate the affixed-together end of the section of hair.

6. The method of claim 1, further comprising:

attaching the second adhesive tape to a second side of the section of hair proximate the affixed-together end of the section of hair prior to attaching the second layer of natural hair to the hair extension.

7. The method of claim 1, wherein the second adhesive tape is double-sided adhesive tape.

8. A method for attaching a hair extension to natural hair of a user, the hair extension including a section of hair and a first adhesive tape, the section of hair being affixed together at one end, the first adhesive tape being attached to a first side of the section of hair proximate the affixed-together end of the section of hair, the method comprising:

parting natural hair of the user to form a part;

attaching the first adhesive tape of the hair extension to a first layer of natural hair of the user below the part;

attaching a first side of a second adhesive tape to a second side of the section of hair proximate the affixed-together end of the section of hair, the second adhesive tape being a double-sided adhesive tape;

lowering a second layer of natural hair of the user from above the part onto a second side of the second adhesive tape after the first side of the second adhesive tape has been attached to the second side of the section of hair;

determining whether natural hair of the user would benefit from additional hold for the hair extension based on at least one of a lifestyle of the user and a type, a texture, and a condition of the natural hair of the user; and where natural hair of the user would benefit from additional hold for the hair extension, attaching a third adhesive tape to the first layer of natural hair such that the third adhesive tape is positioned below the first adhesive tape and the first layer of natural hair is sealed between the third adhesive tape and the first adhesive tape.

9. The method of claim 8, wherein the third adhesive tape is positioned directly below and is substantially aligned with the first adhesive tape across at least 75% of a width of the hair extension.

10. The method of claim 8, wherein:

the section of hair is affixed together at one end by a solidified liquid polymer;

the polymer is exposed on the first and second sides of the section of hair;

the first adhesive tape is attached to the polymer exposed on the first side of the section of hair; and the second adhesive tape is attached to the polymer exposed on the second side of the section of hair.

11. A method for attaching a hair extension to natural hair of a user, the hair extension including a section of hair and a first adhesive tape, the section of hair being affixed together at one end, the first adhesive tape being attached to a first side of the section of hair proximate the affixed-together end of the section of hair, the method comprising:

parting natural hair of the user to form a part;

attaching the first adhesive tape of the hair extension to a first layer of natural hair of the user below the part;

attaching a first side of a second adhesive tape to a second side of the section of hair proximate the affixed-together end of the section of hair, the second adhesive tape being a double-sided adhesive tape;

lowering a second layer of natural hair of the user from above the part onto a second side of the second adhesive tape after the first side of the second adhesive tape has been attached to the second side of the section of hair; and attaching a third adhesive tape to the first layer of natural hair such that the third adhesive tape is positioned below the first adhesive tape and the first layer of natural hair is sealed between the third adhesive tape and the first adhesive tape.

12. The method of claim 11, wherein the third adhesive tape is positioned directly below and is substantially aligned with the first adhesive tape across at least 75% of a width of the hair extension.

13. The method of claim 11, wherein:

the section of hair is affixed together at one end by a solidified liquid polymer;

the polymer is exposed on the first and second sides of the section of hair;

the first adhesive tape is attached to the polymer exposed on the first side of the section of hair; and the second adhesive tape is attached to the polymer exposed on the second side of the section of hair.

* * * * *